US009714158B2

(12) United States Patent
Nakamura et al.

(10) Patent No.: US 9,714,158 B2
(45) Date of Patent: Jul. 25, 2017

(54) ELEVATOR COUNTERWEIGHT DEVICE

(75) Inventors: Hideki Nakamura, Tokyo (JP); Sachiomi Mizuno, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 299 days.

(21) Appl. No.: 14/418,563

(22) PCT Filed: Aug. 14, 2012

(86) PCT No.: PCT/JP2012/070694

§ 371 (c)(1),
(2), (4) Date: Jan. 30, 2015

(87) PCT Pub. No.: WO2014/027399

PCT Pub. Date: Feb. 20, 2014

(65) Prior Publication Data

US 2015/0291396 A1 Oct. 15, 2015

(51) Int. Cl.
*B66B 17/12* (2006.01)
*B66B 7/04* (2006.01)

(52) U.S. Cl.
CPC ..... *B66B 17/12* (2013.01); *B66B 7/047* (2013.01); *B66B 7/048* (2013.01)

(58) Field of Classification Search
CPC ..... B66B 17/12; B66B 7/047; B66B 7/048
See application file for complete search history.

(56) References Cited

U.S. PATENT DOCUMENTS 1,071,309 A * 8/1913 Goggin ..... B66B 9/00 187/266
4,047,597 A * 9/1977 Okura et al. ..... B66B 7/048 187/409
5,080,201 A * 1/1992 Yoo et al. ..... B66B 17/12 187/404
5,353,893 A * 10/1994 Sun et al. ..... B66B 7/068 187/412
5,495,919 A * 3/1996 Ericson et al. ..... B66B 5/22 187/373

(Continued)

FOREIGN PATENT DOCUMENTS

JP 59-80371 5/1984
JP 03-088689 4/1991

(Continued)

OTHER PUBLICATIONS

International Search Report issued Oct. 9, 2012 in PCT/JP2012/070694 filed Aug. 14, 2012.

*Primary Examiner* — Michael Riegelman
(74) *Attorney, Agent, or Firm* — Oblon, McClelland, Maier & Neustadt, L.L.P.

(57) ABSTRACT

In an elevator counterweight device, a frame body includes a first stile, a second stile, a crosshead provided between upper portions of the stiles, and a plank provided between lower portions of the stiles. On both sides of the frame body in a width direction thereof, a plurality of guide devices are provided. Each of the crosshead and the plank is coupled to the first stile and the second stile so as to be pivotable. Each of the guide devices is displaceable in the width direction of the frame body and a thickness direction of the frame body relative to the frame body, and is pivotable about an axis parallel to a vertical direction of the frame body as a center.

7 Claims, 30 Drawing Sheets

(56) References Cited

U.S. PATENT DOCUMENTS

| | | | | |
|---|---|---|---|---|
| 9,586,757 | B2 * | 3/2017 | Kainuma et al. .... | B65G 1/0407 |
| 2004/0094371 | A1 * | 5/2004 | Augugliaro ..... | B66B 17/12 187/404 |
| 2007/0246307 | A1 * | 10/2007 | Cloux et al. ..... | B66B 17/12 187/404 |
| 2014/0013562 | A1 * | 1/2014 | Nakamura et al. ... | B66B 19/007 29/402.01 |
| 2014/0151159 | A1 * | 6/2014 | Mizuno et al. ..... | B66B 5/22 187/359 |
| 2014/0216857 | A1 * | 8/2014 | Mizuno et al. ..... | B66B 5/22 187/359 |
| 2014/0284148 | A1 * | 9/2014 | Albu et al. ..... | B66B 17/12 187/404 |
| 2015/0158670 | A1 * | 6/2015 | Kainuma et al. .... | B65G 1/0407 414/277 |

FOREIGN PATENT DOCUMENTS

| | | | |
|---|---|---|---|
| JP | 09-194163 | A | 7/1997 |
| JP | 09-227053 | | 9/1997 |
| JP | 2007-269442 | | 10/2007 |
| JP | 4618628 | | 1/2011 |
| WO | 2012-090592 | A1 | 7/2012 |

* cited by examiner

ELEVATOR COUNTERWEIGHT DEVICE

TECHNICAL FIELD

The present invention relates to an elevator counterweight device, and more particularly, to a technology of preventing a counterweight device from derailing from guide rails due to seismic shaking.

BACKGROUND ART

In a related-art counterweight device for a general elevator, a plurality of weights are laminated and mounted inside a frame body. The frame body is formed by assembling a pair of stiles, a crosshead, and a plank into a rectangular shape. The crosshead and the plank are fixed to the stiles by welding or a plurality of bolts. Further, a pair of counterweight guide rails for guiding raising and lowering of the counterweight device is installed inside a hoistway. On both sides of the frame body in a width direction thereof, a plurality of guide shoes to be brought into engagement with the counterweight guide rails are mounted (see, for example, Patent Literature 1).

When the counterweight guide rails are deformed (deflected) due to seismic shaking, the related-art counterweight device described above cannot follow the deformation to cause the guide shoes to derail from the guide rails in some cases. This is because the frame body does not deform in response to the deformation of the guide rails and the guide shoes are of fixed type. Further, the laminated weights are merely masses of iron. Therefore, the weights do not have a function of reducing the seismic shaking.

On the other hand, a cage is formed by combining a plurality of thin plates. Therefore, a certain amount of energy of the seismic shaking can be absorbed. In addition, a car platform is supported through an intermediation of a vibration isolation rubber. Further, a passenger can also absorb a certain amount of the seismic shaking. Thus, a car scarcely derails from car guide rails due to the seismic shaking.

For the derailment of the counterweight device described above, a method of using a frame body having a double-frame structure including an outer frame and an inner frame and providing a plurality of vibration isolation rubbers between the outer frame and the inner frame has been proposed (see, for example, Patent Literature 2).

Further, in another related-art elevator apparatus, the counterweight is bent in an upper portion and a lower portion of the hoistway and is extended in an intermediate portion of the hoistway (see, for example, Patent Literature 3).

CITATION LIST

Patent Literature

[PTL 1] JP 9-227053 A
[PTL 2] JP 3-88689 A
[PTL 3] JP 4618628 B2

SUMMARY OF INVENTION

Technical Problem

In the related-art counterweight device using the frame body having the double-frame structure described above, a range in which the shaking is absorbed is small. Therefore, if the deflection of the guide rails is significant, the derailment cannot be prevented. Further, it is for space saving in a top portion and a bottom portion of the hoistway that the counterweight is bent and extended. Therefore, the guide shoes cannot be prevented from derailing from the guide rails due to the deformation of the guide rails caused by the seismic shaking.

The present invention has been made to solve the problem described above, and therefore has an object to provide an elevator counterweight device capable of more reliably preventing guide devices from derailing from guide rails due to deformation of the guide rails.

Solution to Problem

According to one embodiment of the present invention, there is provided an elevator counterweight device, including: a frame body including: a first stile; a second stile; a crosshead provided between an upper portion of the first stile and an upper portion of the second stile; and a plank provided between a lower portion of the first stile and a lower portion of the second stile; a counterweight main body mounted at an inside of the frame body; and a plurality of guide devices provided on both sides of the frame body in a width direction thereof, and to be brought into engagement with a pair of guide rails installed at an inside of a hoistway, the crosshead and the plank being coupled to the first stile and the second stile so as to be pivotable, each of the plurality of guide devices being displaceable in the width direction of the frame body and a thickness direction of the frame body relative to the frame body, and being pivotable about an axis parallel to a vertical direction of the frame body as a center.

Advantageous Effects of Invention

The elevator counterweight device according to the one embodiment of the present invention includes the crosshead and the plank, each being coupled to the first stile and the second stile so as to be pivotable. Each of the guide devices is displaceable in the width direction of the frame body and the thickness direction of the frame body relative to the frame body, and is pivotable about the axis parallel to the vertical direction of the frame body as the center. Therefore, the elevator counterweight device can follow the deformation of the guide rails due to the seismic shaking or the like with the deformation of the frame body and the displacement and pivoting of the guide devices. Thus, the guide devices can be more reliably prevented from derailing from the guide rails.

DESCRIPTION OF EMBODIMENTS

Figure 1:
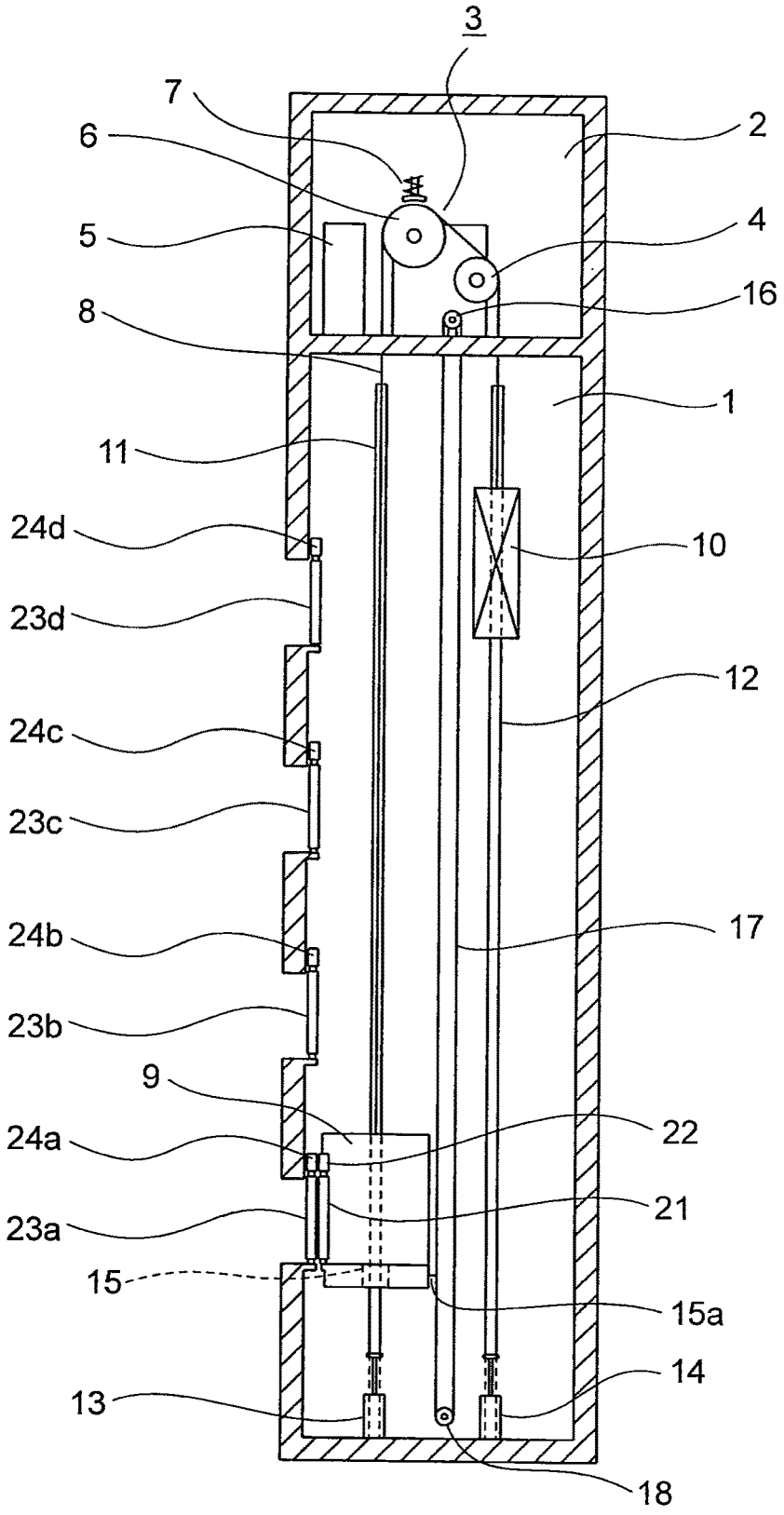
FIG. 1 is a configuration diagram illustrating an elevator apparatus according to a first embodiment of the present invention.

Now, embodiments of the present invention are described referring to the drawings.

First Embodiment

FIG. 1 is a configuration diagram illustrating an elevator apparatus according to a first embodiment of the present invention. In FIG. 1, in an upper portion of a hoistway 1, a machine room 2 is provided. In the machine room 2, a hoisting machine (driving device) 3, a deflector sheave 4, and a controller 5 are provided. The hoisting machine 3 includes a driving sheave 6, a hoisting-machine motor for rotating the driving sheave 6, and a hoisting-machine brake (electromagnetic brake) 7 as a brake device for braking the rotation of the driving sheave 6.

A suspension body 8 is wound around the driving sheave 6 and the deflector sheave 4. As the suspension body 8, a plurality of ropes or a plurality of belts are used. A car 9 is connected to a first end portion of the suspension body 8. A counterweight device 10 is connected to a second end portion of the suspension body 8.

The car 9 and the counterweight device 10 are suspended by the suspension body 8 inside the hoistway 1, and are raised and lowered inside the hoistway 1 by the hoisting machine 3. The controller 5 controls the rotation of the hoisting machine 3 to raise and lower the car 9 at a set speed.

Inside the hoistway 1, a pair of car guide rails 11 for guiding the raising and lowering of the car 9 and a pair of counterweight guide rails 12 for guiding the raising and lowering of the counterweight device 10 are installed. The car guide rails 11 are provided on both sides of the car 9 in a width direction thereof. The counterweight guide rails 12 are provided on both sides of the counterweight device 10 in the width direction.

On a bottom portion of the hoistway 1, a car buffer 13 for buffering an impact of the car 9 on the hoistway bottom portion and a counterweight buffer 14 for buffering an impact of the counterweight device 10 on the hoistway bottom portion are installed.

At a lower portion of the car 9, a safety device 15 to be brought into engagement with the car guide rails 11 to cause the car 9 to make an emergency stop is mounted.

In the machine room 2, a car speed governor 16 for detecting running of the car 9 at an overspeed is provided. A car speed governor rope 17 is wound around the car speed governor 16. The car speed governor rope 17 is provided in an annular manner inside the hoistway 1, and is connected to the car safety device 15 through an intermediation of an actuating lever 15*a*. Further, the car speed governor rope 17 is wound around a car speed governor rope tension sheave 18 provided in a lower portion of the hoistway 1. In this manner, when the car 9 is raised and lowered, the car speed governor rope 17 is moved in a circulating manner.

When a raising/lowering speed of the car 9 becomes equal to a preset first overspeed (which is generally about 1.3 times as high as a rated speed), the car speed governor 16 deenergizes the hoisting machine 3 to stop the car 9 by the hoisting-machine brake 7.

Further, when the car 9 continues moving down without stopping even after the hoisting machine 3 stops as in a case where, for example, the suspension body 8 breaks and the car speed then becomes equal to a preset second overspeed (which is generally about 1.4 times as high as the rated speed), the car speed governor 16 grips the car speed governor rope 17 to stop the circulating movement of the car speed governor rope 17. As a result, the actuating lever 15*a* is pulled up for the car 9 to actuate the car safety device 15, thereby causing the car 9 to make an emergency stop.

The car 9 is provided with a pair of car doors 21 and a car door device 22 for driving the car doors 21 to be opened and closed. The opening and closure of the car doors 21 are controlled by the controller 5.

Each of pairs of landing doors 23*a* to 23*d* is provided to a landing on each of a plurality of floors. The landing doors 23*a* to 23*d* are opened and closed in conjunction with the opening and closure of the car doors 21 when the car 9 stops at a landing position. Above the respective landing doors 23*a* to 23*d*, landing-door guide devices 24*a* to 24*d* for guiding opening/closing movement of the corresponding landing doors 23*a* to 23*d* are provided.

Figure 2:
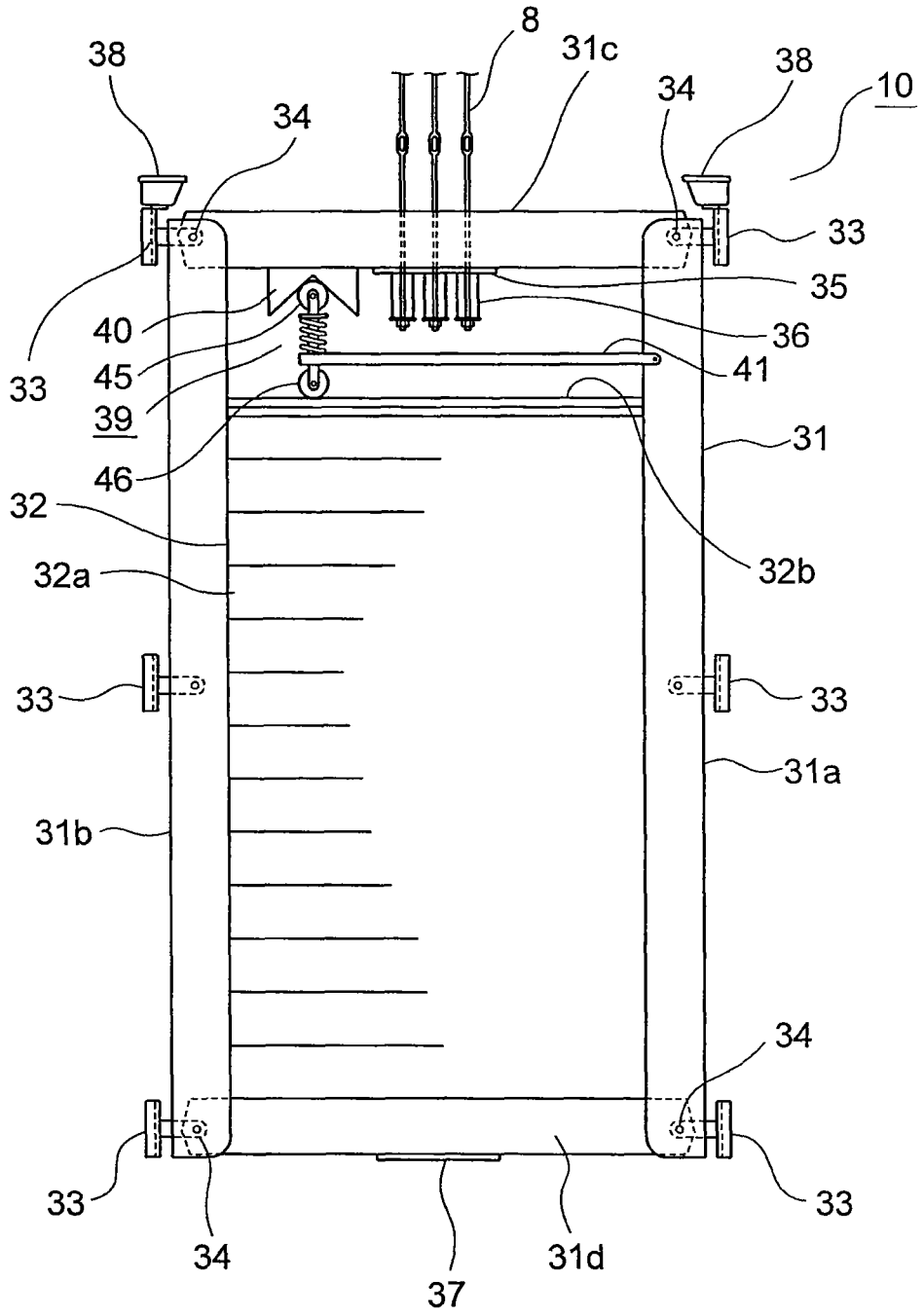
FIG. 2 is a front view illustrating a counterweight device illustrated in FIG. 1.

FIG. 2 is a front view illustrating the counterweight device 10 illustrated in FIG. 1. The counterweight device 10 includes a frame body 31, a counterweight main body 32 mounted at an inside of the frame body 31, and a plurality of (six in this example) guide shoes (sliding shoes) 33 as guide devices, which are provided on both sides of the frame body 31 in a width direction thereof (horizontal direction in FIG. 2).

The frame body 31 includes a first stile 31*a* and a second stile 31*b*, a crosshead 31*c* provided horizontally between an upper portion of the first stile 31*a* and an upper portion of the second stile 31*b*, and a plank 31*d* provided horizontally between a lower portion of the first stile 31*a* and a lower portion of the second stile 31*b*. The first stile 31*a* and the second stile 31*b* are parallel to each other, whereas the crosshead 31*c* and the plank 31*d* are parallel to each other.

Both longitudinal end portions of the crosshead 31*c* are coupled to an upper end portion of the first stile 31*a* and an upper end portion of the second stile 31*b* through pins 34 so as to be pivotable. Both longitudinal end portions of the plank 31*d* are coupled to a lower end portion of the first stile 31*a* and a lower end portion of the second stile 31*b* through the pins 34 so as to be pivotable. As each of the pins 34, a reamer bolt is used.

The frame body 31 normally has a rectangular shape. However, when the counterweight guide rails 12 are deformed due to seismic shaking or the like, the frame body 31 can be deformed into a parallelogram in accordance with the deformation of the counterweight guide rails 12.

On a lower surface of the crosshead 31*c*, a rope stopper plate 35 is fixed. The suspension body 8 is connected to the rope stopper plate 35 through an intermediation of a plurality of fasteners 36. On a lower surface of the plank 31*d*, a buffer contact plate 37 to be brought into contact with the counterweight buffer 14 is fixed.

The counterweight main body 32 includes a plurality of block-like main weights 32*a* laminated at an inside of the frame body 31 and a plurality of plate-like adjustment weights 32*b* placed on the laminate of the main weights 32*a*. Each of the adjustment weights 32*b* is thinner and lighter than each of the main weights 32*a*.

The guide shoes 33 are respectively provided to the upper end portions, intermediate portions, and the lower end portions of the stiles 31*a* and 31*b*. The guide shoes 33 located on the upper end portions of the stiles 31*a* and 31*b* are respectively provided with oil feeders 38.

The frame body 31 is provided with a shape retaining device 39 for generating a force for restoring the frame body 31 to the rectangular shape when the frame body 31 is deformed due to the deformation of the counterweight guide rails 12.

Figure 3:
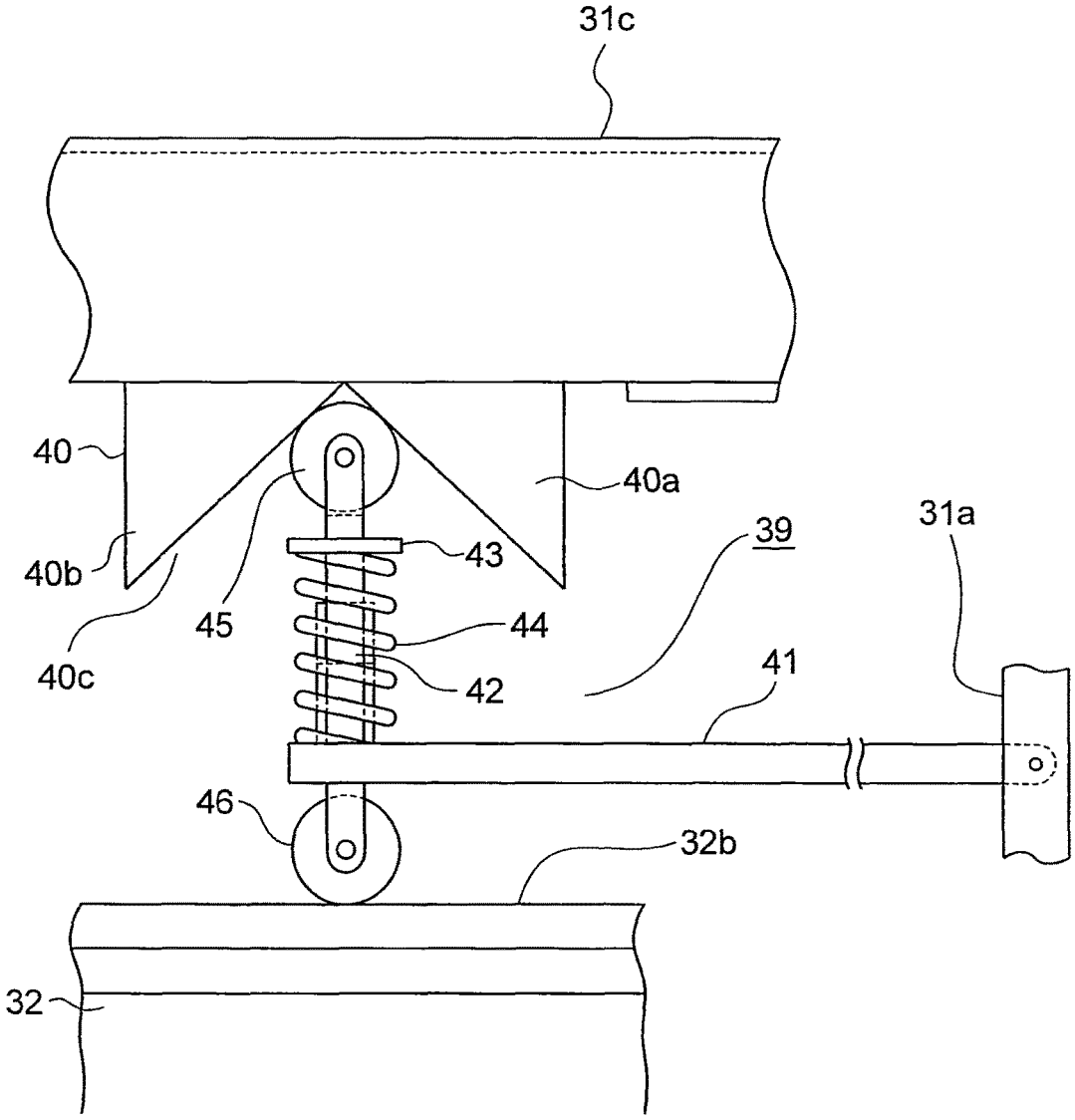
FIG. 3 is a front view illustrating a shape retaining device illustrated in FIG. 2 in an enlarged manner.

FIG. 3 is a front view illustrating the shape retaining device 39 illustrated in FIG. 2 in an enlarged manner. The shape retaining device 39 includes a cam body 40, an arm 41, a bearing 42 provided with a damper, a spring bearing 43, a pressing spring 44, a pressing roller 45, and an auxiliary roller 46.

The cam body 40 includes a first triangular cam 40*a* and a second triangular cam 40*b*, which are fixed onto a lower surface of the crosshead 31*c*. The first triangular cam 40*a* and the second triangular cam 40*b* are right-triangular shaped blocks and provided so as to be oriented in the opposite directions. As a result, the cam body 40 includes a cam groove (valley portion) 40*c* having a triangular sectional shape.

A base end portion of the arm 41 is coupled to the first stile 31*a* so as to be rockable. The arm 41 may be coupled to the second stile 31*b* or may be coupled to both of the stiles 31*a* and 31*b*. The bearing 42 provided with the damper is supported onto an upper surface of a distal end portion of the arm 41. The bearing 42 provided with the damper is extendible and contractible in an axial direction (vertical direction).

The pressing roller 45 is provided to an upper end portion of the bearing 42 provided with the damper and is held in contact with inner surfaces of the cam groove 40*c*. The auxiliary roller 46 is mounted to a lower surface of the distal end portion of the arm 41 and is held in contact with an upper surface of the adjustment weights 32*b*.

The spring bearing 43 is fixed in the vicinity of the upper end portion of the bearing 42 provided with the damper. The pressing spring 44 is located between the spring bearing 43 and an upper surface of the arm 41. By biasing the spring bearing 43 in a direction in which the bearing 42 with the damper is extended, the pressing roller 45 is pressed against the cam groove 40*c*.

When the frame body 31 is deformed due to the deformation of the counterweight guide rails 12, the arm 41 is moved to any one of the right and left of the frame body 31 in the width direction to move the pressing roller 45 inside the cam groove 40*c*. At this time, by inclined surfaces of the cam groove 40*c*, the pressing roller 45 is moved down against a spring force of the pressing spring 44 to press and contract the bearing 42 with the damper. As a result, a restoring force of the pressing spring 44, specifically, a force for restoring the frame body 31 to the rectangular shape is generated.

Figure 4:
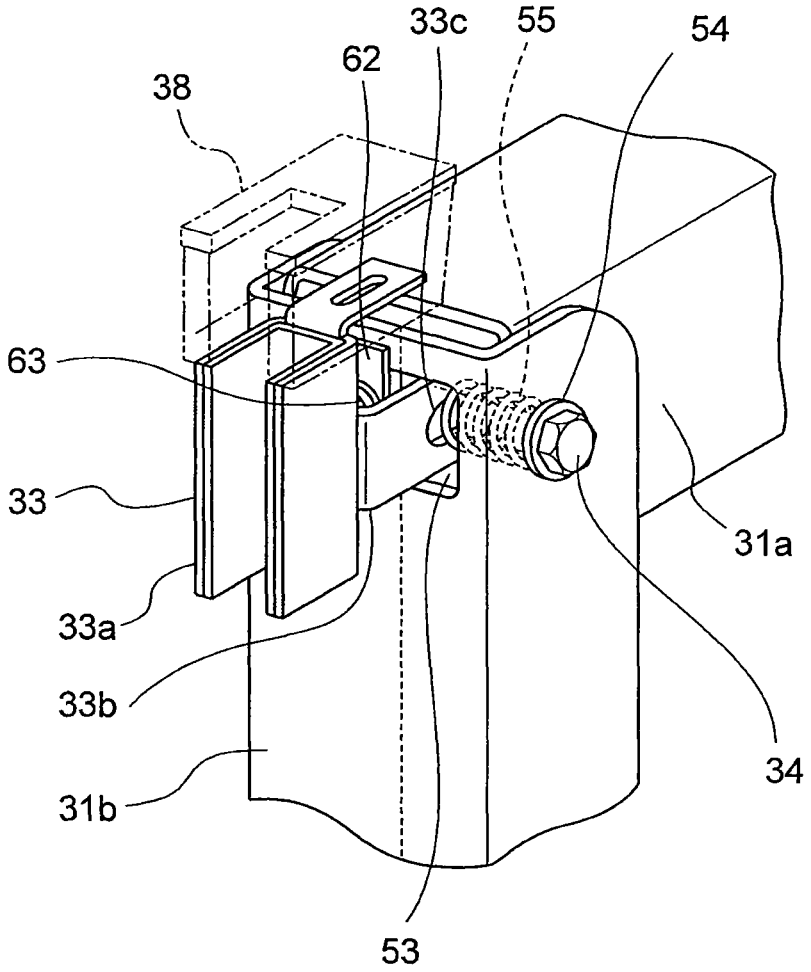
FIG. 4 is a perspective view illustrating a coupling portion between a second stile and a crosshead illustrated in FIG. 2 in an enlarged manner.
Figure 5:
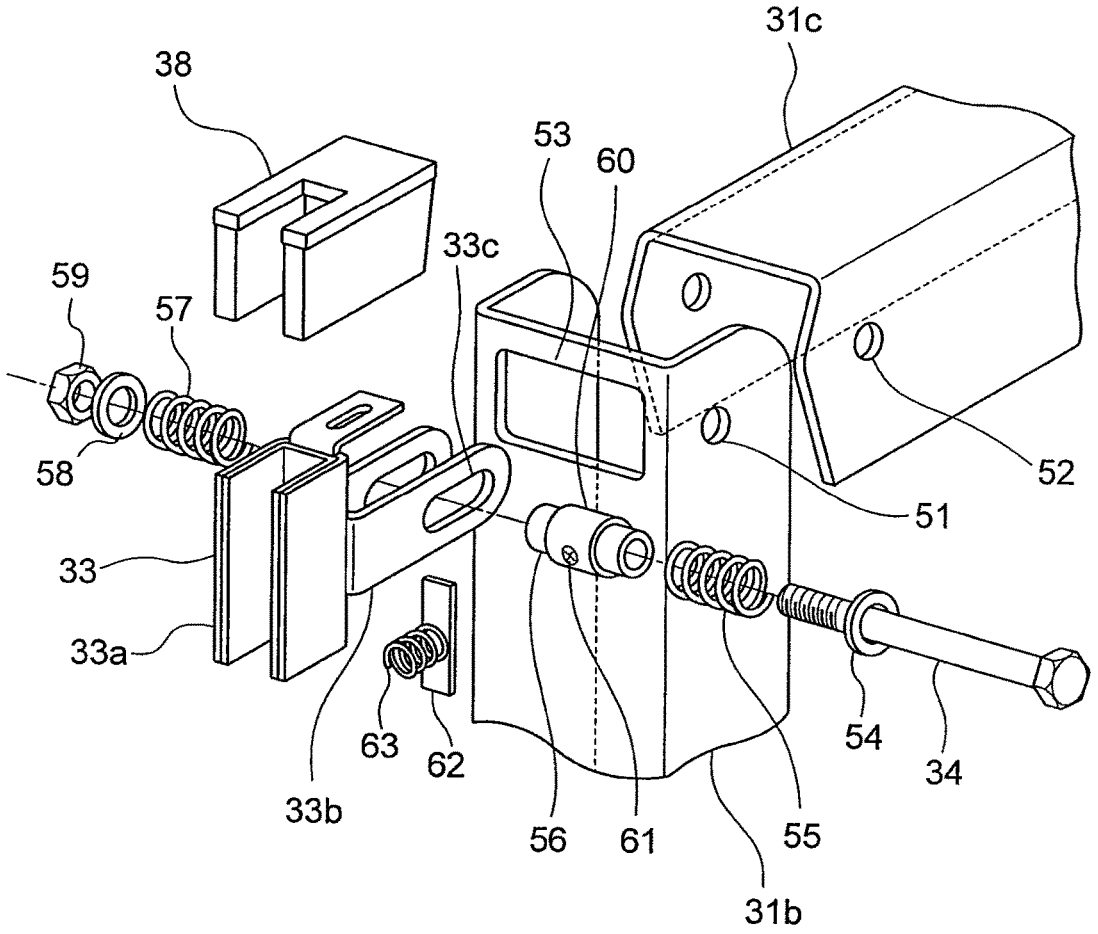
FIG. 5 is an exploded perspective view illustrating the coupling portion illustrated in FIG. 4.
Figure 6:
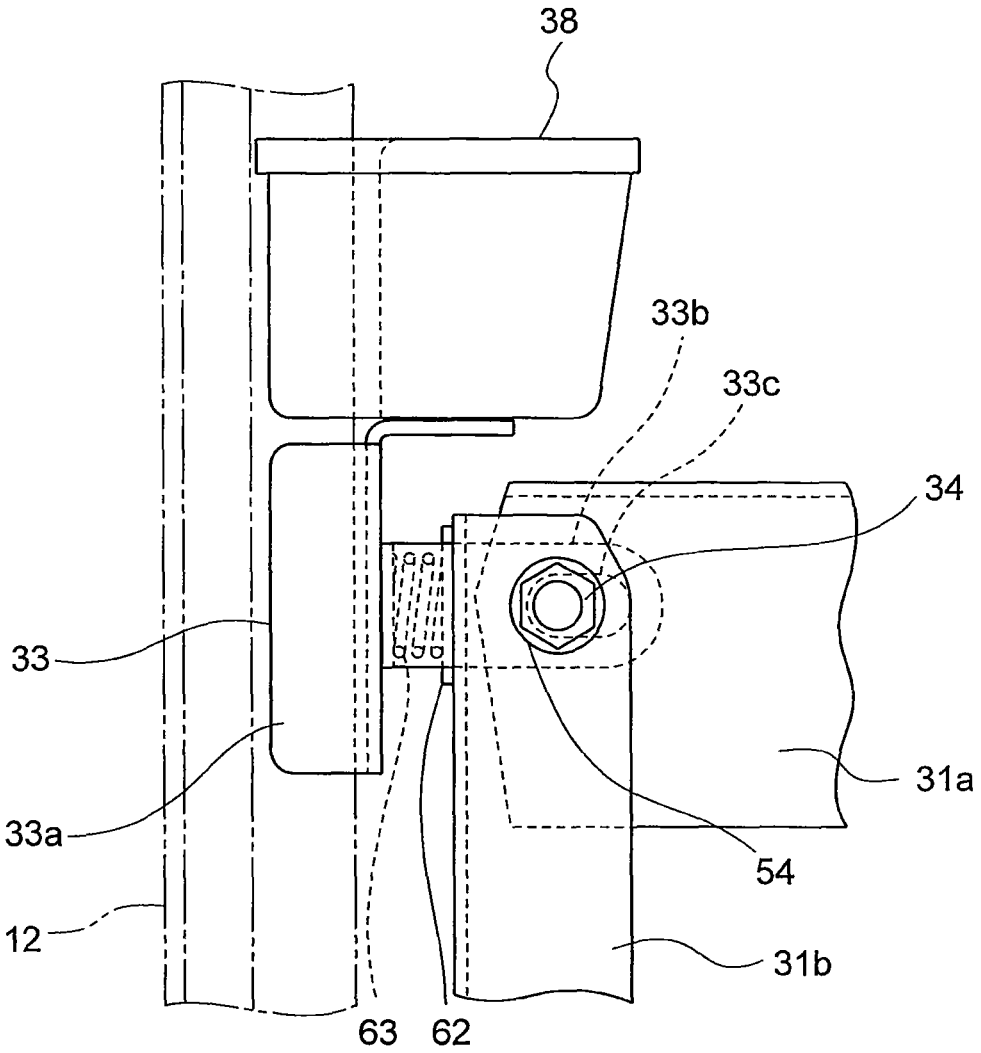
FIG. 6 is a front view illustrating the coupling portion illustrated in FIG. 4.
Figure 7:
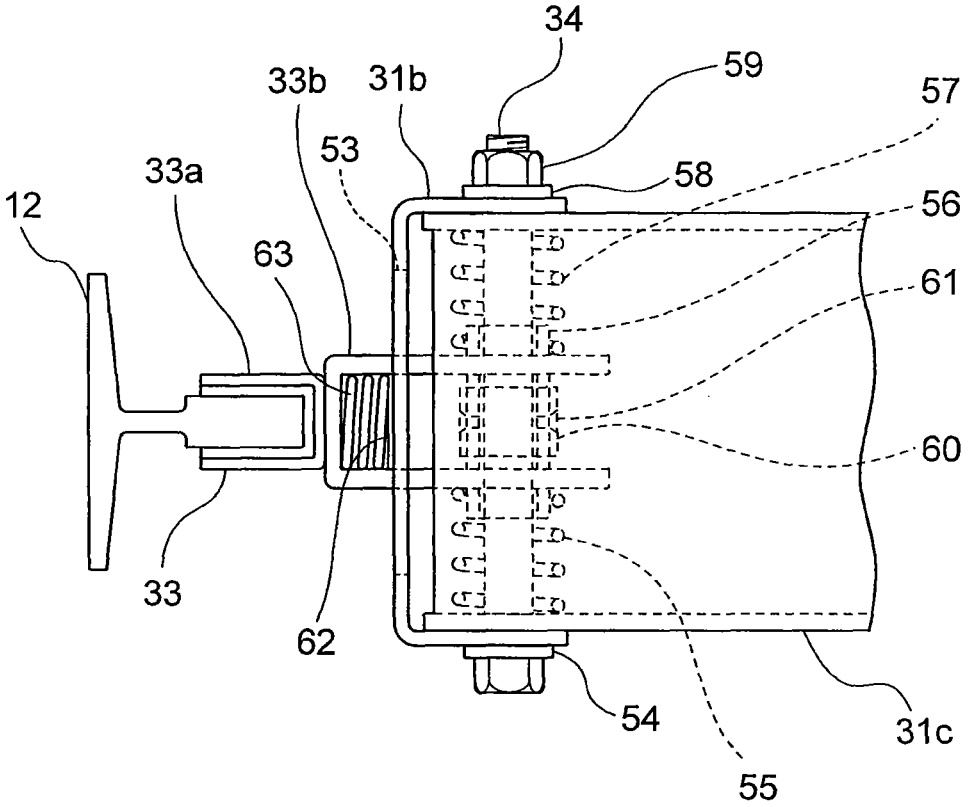
FIG. 7 is a plan view illustrating the coupling portion illustrated in FIG. 4.

FIG. 4 is a perspective view illustrating a coupling portion between the second stile 31*b* and the crosshead 31*c* illustrated in FIG. 2 in an enlarger manner, FIG. 5 is an exploded perspective view illustrating the coupling portion illustrated in FIG. 4, FIG. 6 is a front view illustrating the coupling portion illustrated in FIG. 4, and FIG. 7 is a plan view illustrating the coupling portion illustrated in FIG. 4.

A pair of through holes 51 through which the pin (reamer bolt) 34 passes is formed in the second stile 31*b*, whereas a pair of through holes 52 through which the pin 34 passes is formed in the crosshead 31*c* (FIG. 5). Specifically, the pin 34 horizontally passes through the second stile 31*b* and the crosshead 31*c*. The second stile 31*b* and the crosshead 31*c* are coupled to each other so as to be pivotable about the pin 34 as a center.

The guide shoe 33 includes a shoe main body 33*a* to be brought into engagement with the counterweight guide rail 12 and a shoe supporting portion (neck portion) 33*b* having a U-like shape, which is provided on a back surface of the shoe main body 33*a*. A pair of elongated holes 33*c* through which the pin 34 passes is formed in the shoe supporting portion 33*b*. An opening 53 into which the shoe supporting portion 33*b* is inserted is formed in the second stile 31*b*.

A washer 54, a first thickness-direction spring 55, a collar 56 having a cylindrical shape, a second thickness-direction spring 57, and a washer 58 are passed over the pin 34 in the stated order from a head portion side. A nut 59 is screwed onto a threaded portion at a distal end of the pin 34.

The washer 54 is present between the head portion of the pin 34 and a side surface of the second stile 31*b*. The washer 58 is present between the nut 59 and a side surface of the second stile 31*b*. The first thickness-direction spring 55 and the second thickness-direction spring 57 are located between the shoe supporting portion 33*b* and an inner surface of the crosshead 31*c* on both sides of the shoe supporting portion 33*b*.

An axial intermediate portion of the collar 56 is located at an inside of the shoe supporting portion 33*b*. Both axial end portions of the collar 56 are respectively inserted into the elongated holes 33*c*. The collar 56 is movable along the elongated holes 33*c* relative to the shoe supporting portion 33*b*.

Figure 8:
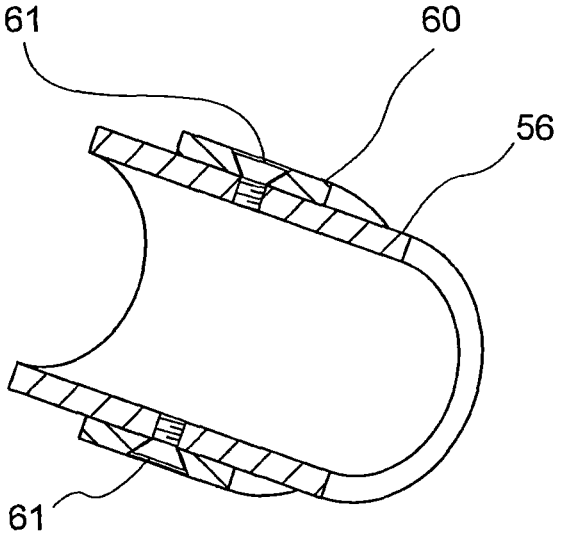
FIG. 8 is a perspective view illustrating a collar and a stopper illustrated in FIG. 5, which are cut into half.

On an outer circumference of the intermediate portion of the collar 56, a stopper 60 having a cylindrical shape for preventing the collar 56 from being removed from the elongated holes 33*c* is provided. The stopper 60 is fixed to the collar 56 by a pair of countersunk screws 61, as illustrated in FIG. 8.

A spring supporting plate 62, which vertically traverses the opening 53, is provided to the second stile 31*b*. The spring supporting plate 62 is slidable in a thickness direction of the frame body 31 (vertical direction in FIG. 7). A width-direction spring 63 for biasing the guide shoe 33 in a direction in which the guide shoe 33 projects outward from the second stile 31*b* in the width direction of the frame body 31 is provided to the spring supporting plate 62.

FIGS. 4 to 8 illustrate the structure for supporting the upper left guide shoe 33 illustrated in FIG. 2, and the other guide shoes are supported by the same structures. By the supporting structures described above, each of the guide shoes 33 can be displaced in the width direction of the frame body 31 and the thickness direction of the frame body 31 relative to the frame body 31 and can also be pivoted (swung) about an axis parallel to the vertical direction of the frame 31 (longitudinal direction of the stiles 31*a* and 31*b*) as a center.

Figure 9:
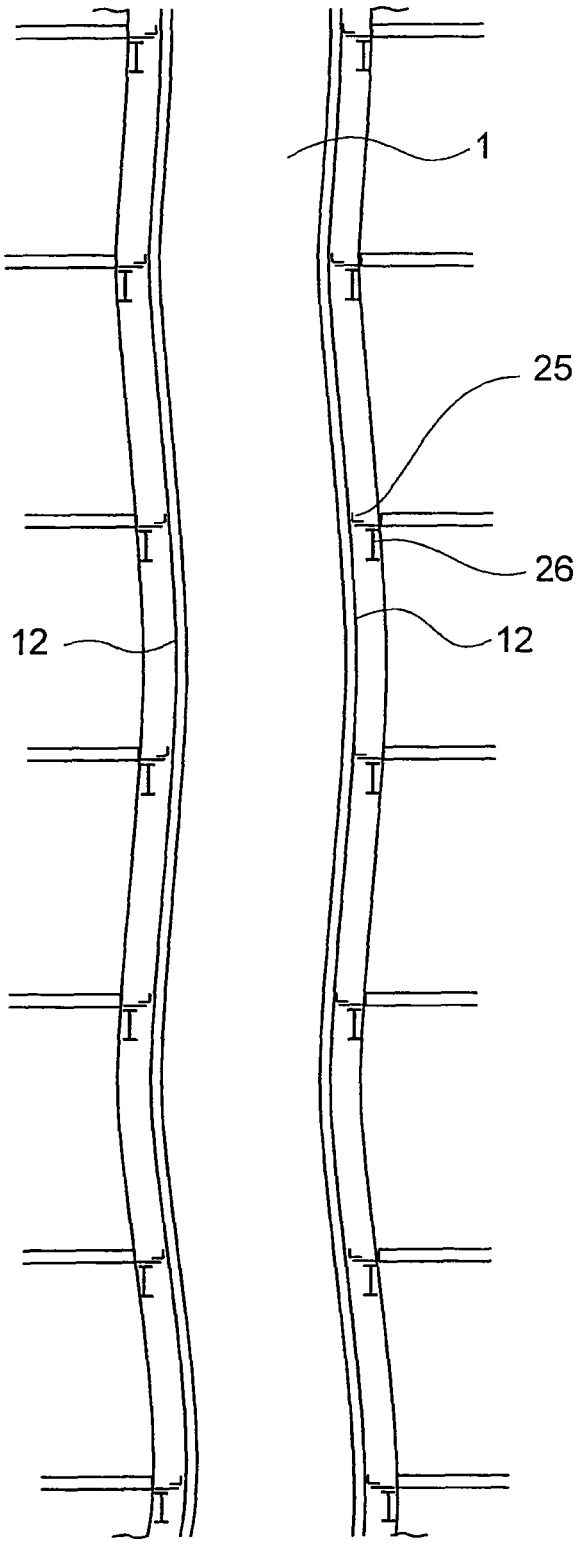
FIG. 9 is an explanatory diagram illustrating a state in which counterweight guide rails illustrated in FIG. 1 are deformed in a width direction of the counterweight device.
Figure 10:
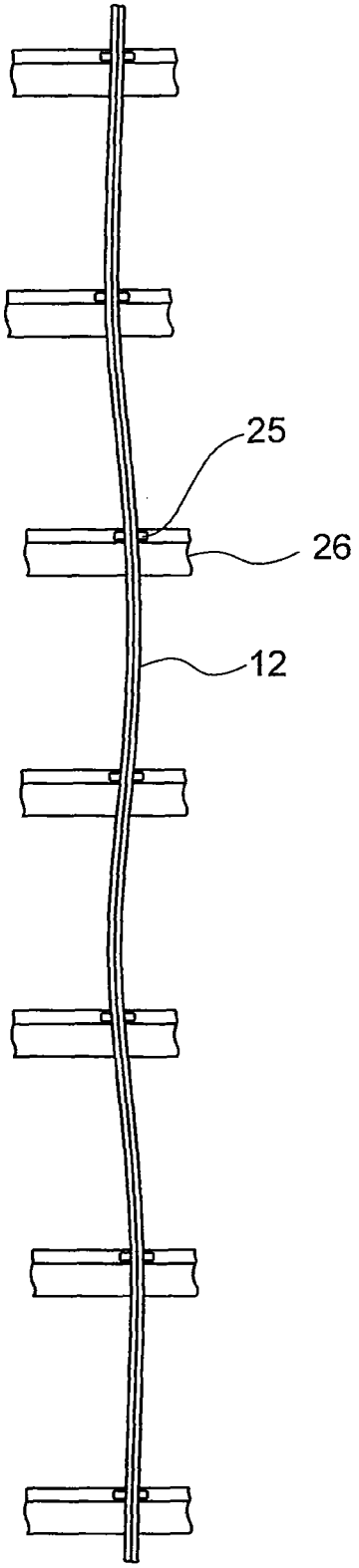
FIG. 10 is an explanatory diagram illustrating a state in which the counterweight guide rails illustrated in FIG. 1 are deformed in a thickness direction of the counterweight device.

Next, an operation is described. FIG. 9 is an explanatory diagram illustrating a state in which the counterweight guide rails 12 illustrated in FIG. 1 are deformed in the width direction of the counterweight device 10, and FIG. 10 is an explanatory diagram illustrating a state in which the counterweight guide rails 12 illustrated in FIG. 1 are deformed in the thickness direction of the counterweight device 10. Each of the counterweight guide rails 12 is fixed to a plurality of building floor girders 26 through an intermediation of a plurality of rail mounting metal fittings 25. Therefore, when a building is deformed due to the seismic shaking, a wavy deformation as illustrated in FIGS. 9 and 10 also occurs in the counterweight guide rails 12 in some cases.

Figure 11:
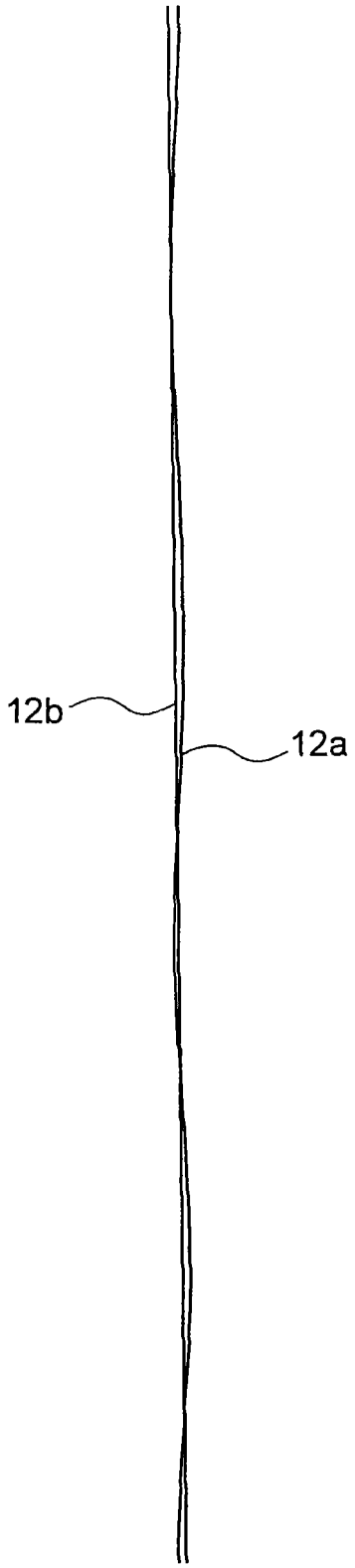
FIG. 11 is an explanatory diagram illustrating a state in which different deformations respectively occur in the right and left counterweight guide rails illustrated in FIG. 1.

At this time, similar deformations occur in the right and left counterweight guide rails 12 in some cases, but there are also other cases where different deformations occur in the right and left counterweight guide rails 12, for example, as illustrated in FIG. 11. In FIG. 11, a center line of one of the counterweight guide rails 12 is indicated by a line 12*a*, and a center line of another of the counterweight guide rails 12 is indicated by a line 12*b*.

Figure 12:
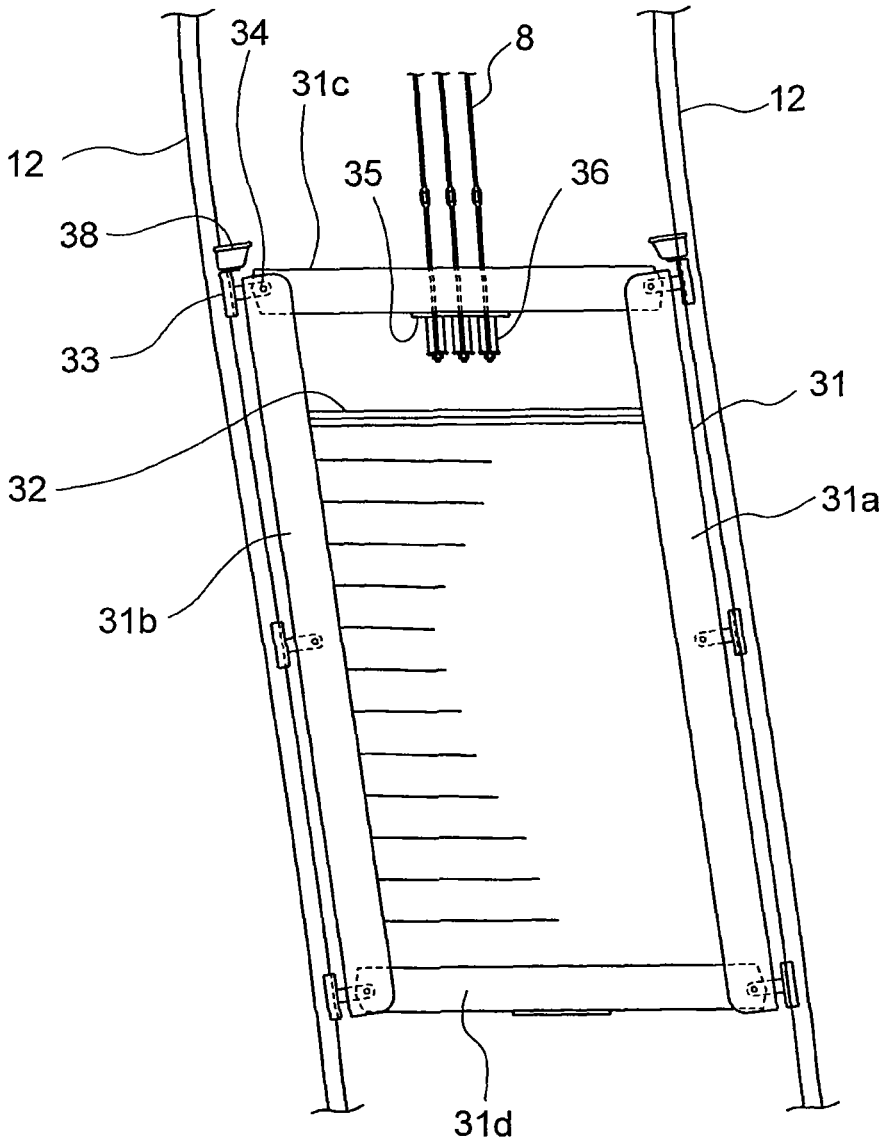
FIG. 12 is a front view illustrating a state of the counterweight device when the counterweight guide rails are deformed as illustrated in FIG. 9.
Figure 13:
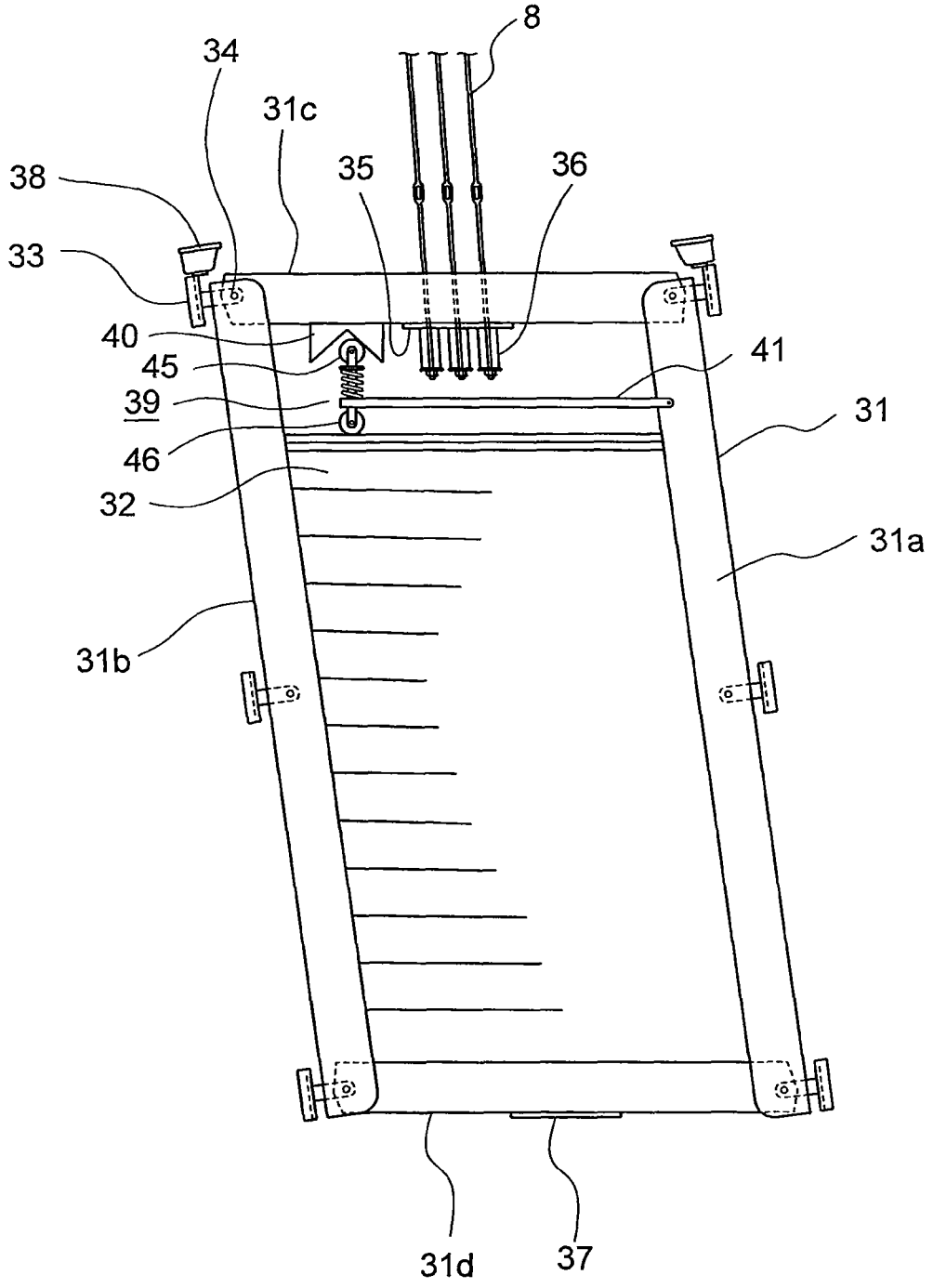
FIG. 13 is a front view illustrating the counterweight device illustrated in FIG. 12 in an enlarged manner.
Figure 14:
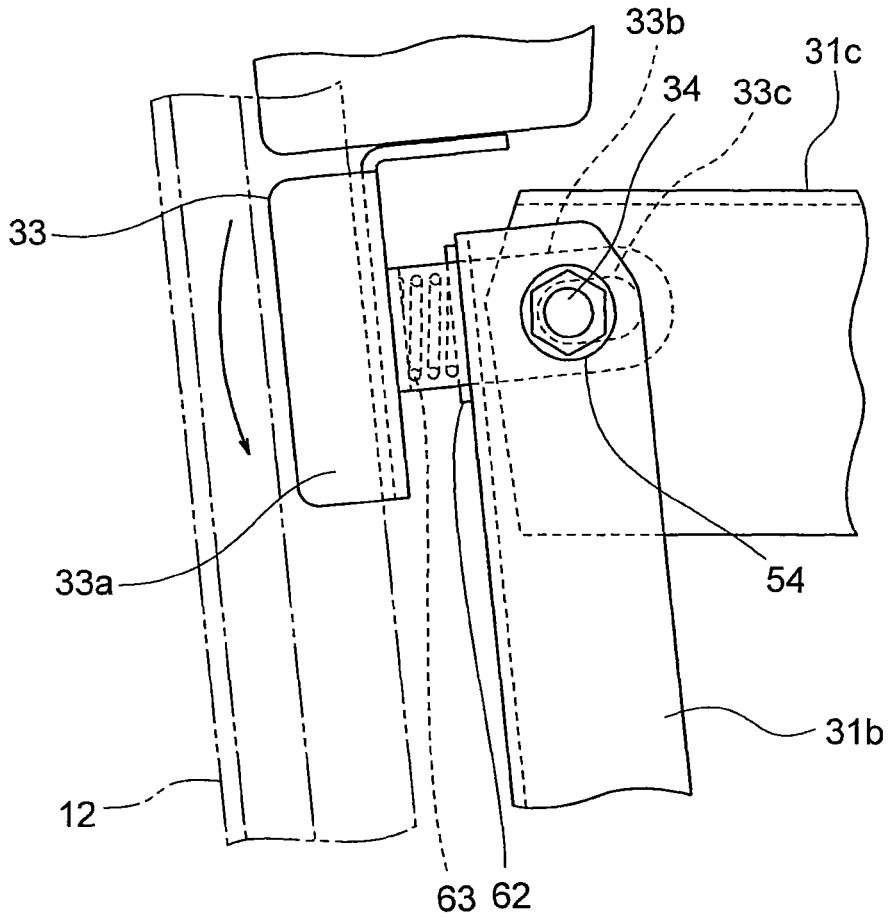
FIG. 14 is a front view illustrating the coupling portion between the second stile and the crosshead illustrated in FIG. 12.

FIG. 12 is a front view illustrating a state of the counterweight device 10 when the counterweight guide rails 12 are deformed as illustrated in FIG. 9, FIG. 13 is a front view illustrating the counterweight device 10 illustrated in FIG. 12 in an enlarged manner, and FIG. 14 is a front view illustrating the coupling portion between the second stile 31*b* and the crosshead 31*c* illustrated in FIG. 12. In FIG. 12, the illustration of the shape retaining device 39 is omitted.

When the counterweight guide rails 12 are deformed in the width direction of the counterweight device 10, the frame body 31 is deformed into a parallelogram in accordance with the deformation of the counterweight guide rails 12 while keeping the counterweight main body 32 as illustrated in FIGS. 12 and 13. In this manner, an engaged state of the guide shoes 33 with the counterweight guide rails 12 is maintained.

Figure 15:
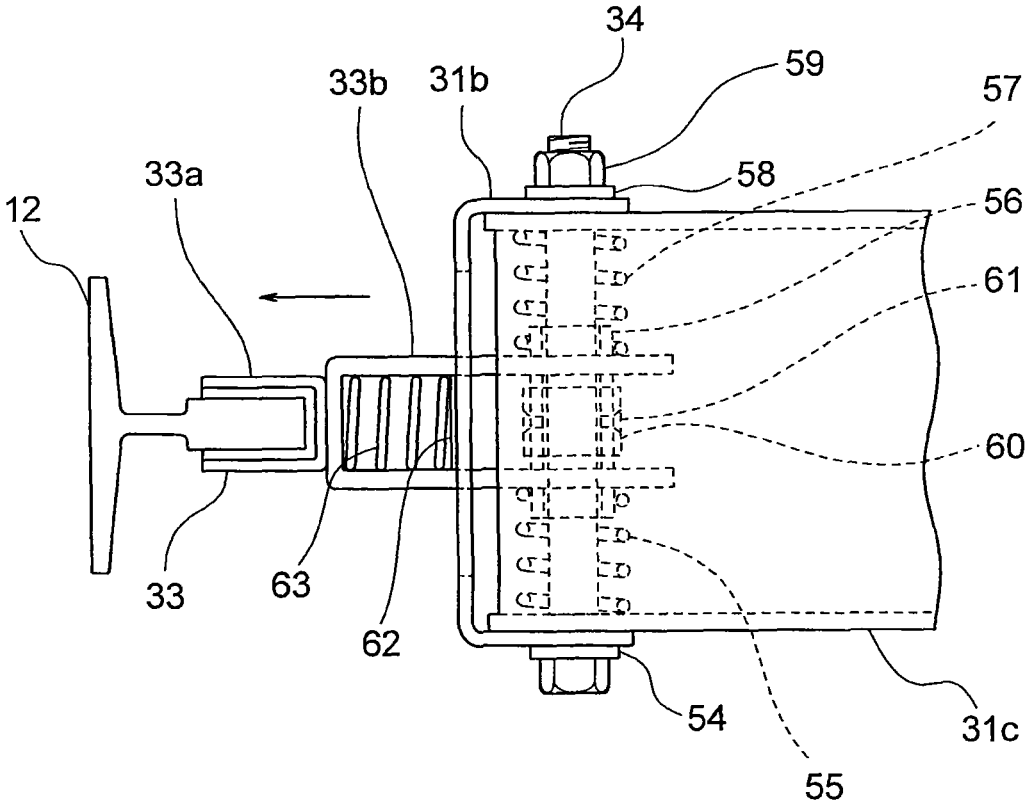
FIG. 15 is a plan view illustrating a state in which a distance between the second stile and the counterweight guide rail illustrated in FIG. 7 becomes larger.

FIG. 15 is a plan view illustrating a state in which a distance between the second stile 31*b* and the counterweight guide rail 12 illustrated in FIG. 7 becomes larger. As illustrated in FIG. 15, when the distance between the stiles 31*a* and 31*b* and the counterweight guide rails 12 changes in the width direction of the frame body 31 due to the deformation of the counterweight guide rails 12, the guide shoes 33 are displaced in the width direction of the frame body 31 relative to the stiles 31*a* and 31*b* by the extension and contraction of the width-direction springs 63. In this manner, the engaged state of the guide shoes 33 with the counterweight guide rails 12 is maintained.

Figure 16:
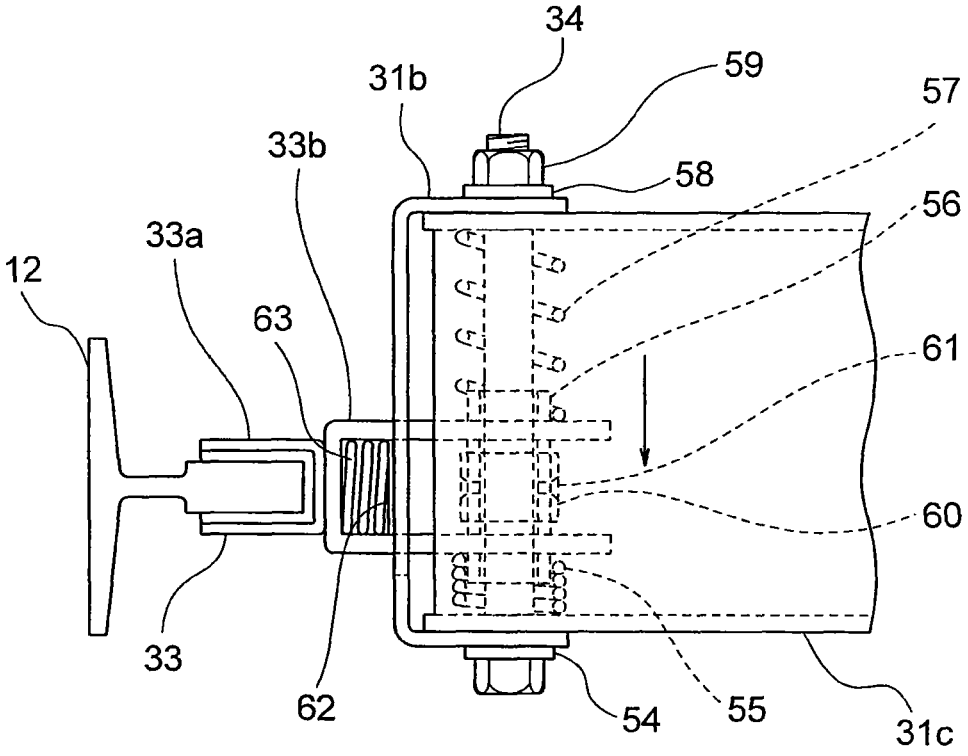
FIG. 16 is a plan view illustrating a state in which the counterweight guide rail illustrated in FIG. 7 is displaced in a thickness direction of a frame body relative to the second stile.

FIG. 16 is a plan view illustrating a state in which the counterweight guide rail 12 illustrated in FIG. 7 is displaced in the thickness direction of the frame body 31 relative to the second stile 31*b*. As illustrated in FIG. 16, when the counterweight guide rails 12 are displaced in the thickness direction of the frame body 31 relative to the stiles 31*a* and 31*b* due to the deformation of the counterweight guide rails 12, the guide shoes 33 are displaced in the thickness direction of the frame body 31 relative to the stiles 31*a* and 31*b* by the extension and contraction of the thickness-direction springs 55 and 57. In this manner, the engaged state of the guide shoes 33 with the counterweight guide rails 12 is maintained.

Figure 17:
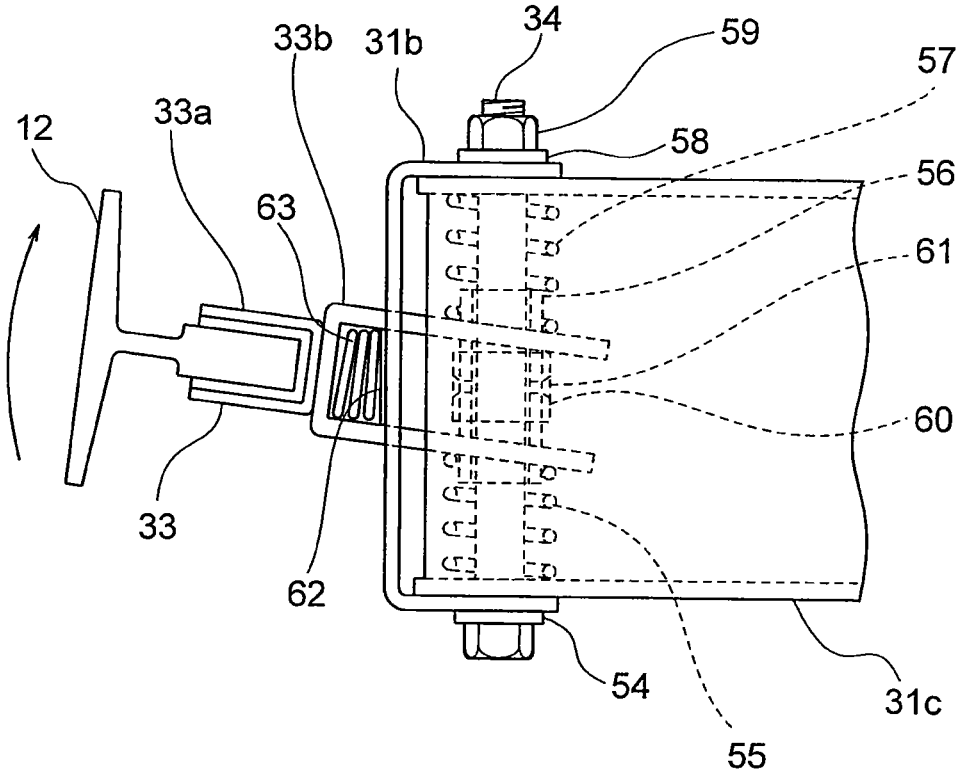
FIG. 17 is a plan view illustrating a state in which twist occurs in the counterweight guide rail illustrated in FIG. 7.

FIG. 17 is a plan view illustrating a state in which twist occurs in the counterweight guide rail 12 illustrated in FIG. 7. As illustrated in FIG. 17, when the counterweight guide rail 12 is deformed in a twisted manner, the guide shoe 33 is pivoted (swung) about the axis parallel to the vertical direction of the frame body 31 as a center. In this manner, the engaged state of the guide shoes 33 with the counterweight guide rails 12 is maintained.

In the counterweight device 10 described above, the crosshead and the plank are coupled (connected by the pins) to the first and second stiles at four corners of the frame body 31 so as to be pivotable. Each of the guide shoes 33 is displaceable in the width direction of the frame body 31 and the thickness direction of the frame body 31 relative to the frame body 31, and is pivotable about the axis parallel to the vertical direction of the frame body 31 as the center. Therefore, the counterweight device 10 can flexibly follow the deformation of the counterweight guide rails 12 due to the seismic shaking or the like with the deformation of the frame body 31 and the displacement and pivoting of the guide shoes 33. As a result, the guide shoes 33 can be more reliably prevented from derailing from the counterweight guide rails 12.

The shape retaining device 39 for generating the force for restoring the frame body 31 to the rectangular shape is provided to the frame body 31. Therefore, in a case where the counterweight guide rails 12 are not deformed, the shape of the frame body 31 is maintained as the rectangular shape. Thus, the counterweight device 10 can be stably raised and lowered.

Further, the shape retaining device 39 including the cam body 40, the pressing roller 45, the arm 41, and the pressing spring 44 is used. Therefore, the shape of the frame body 31 can be maintained as the rectangular shape with a simple configuration.

Second Embodiment

Figure 18:
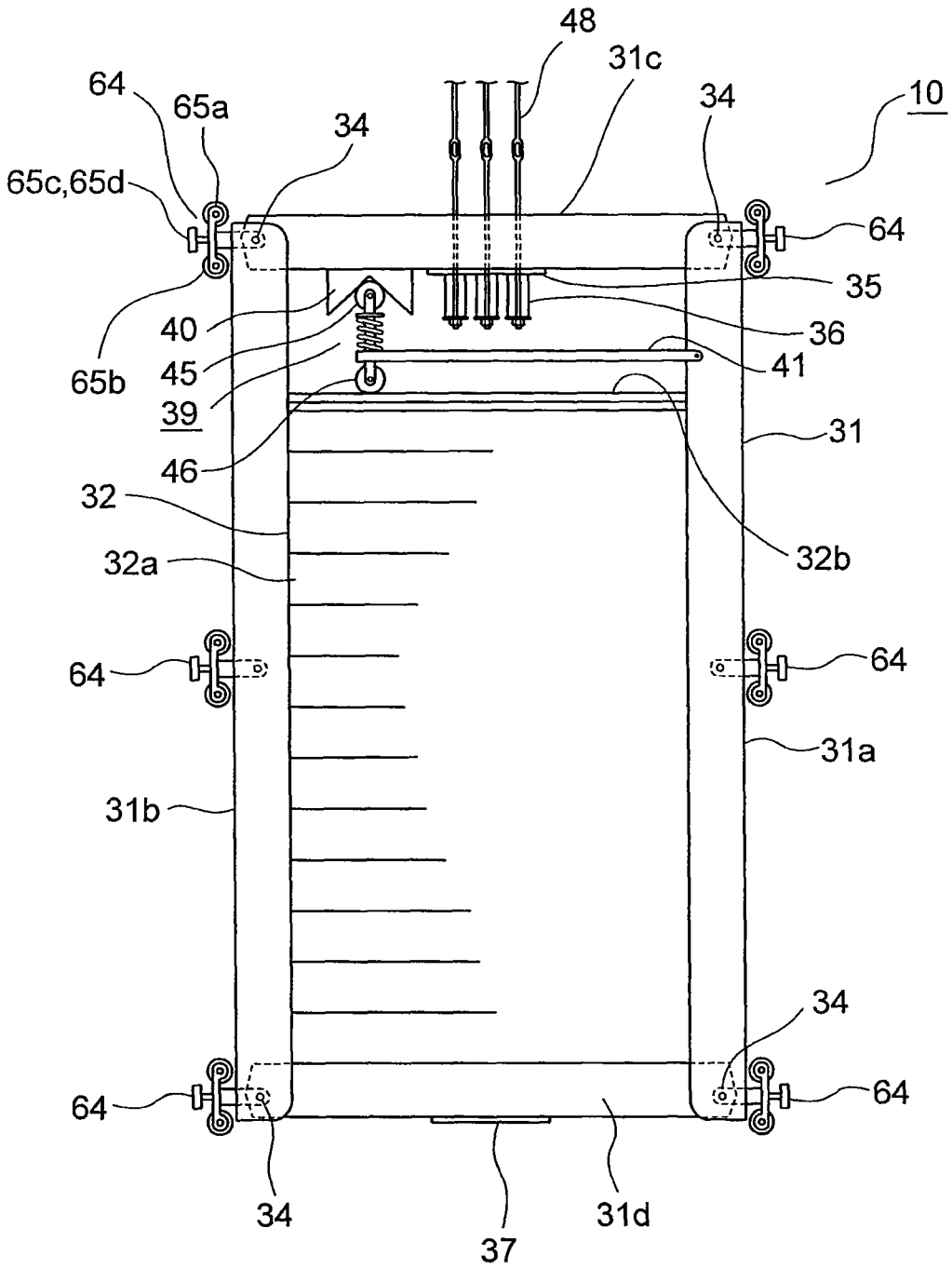
FIG. 18 is a front view illustrating a counterweight device according to a second embodiment of the present invention.
Figure 19:
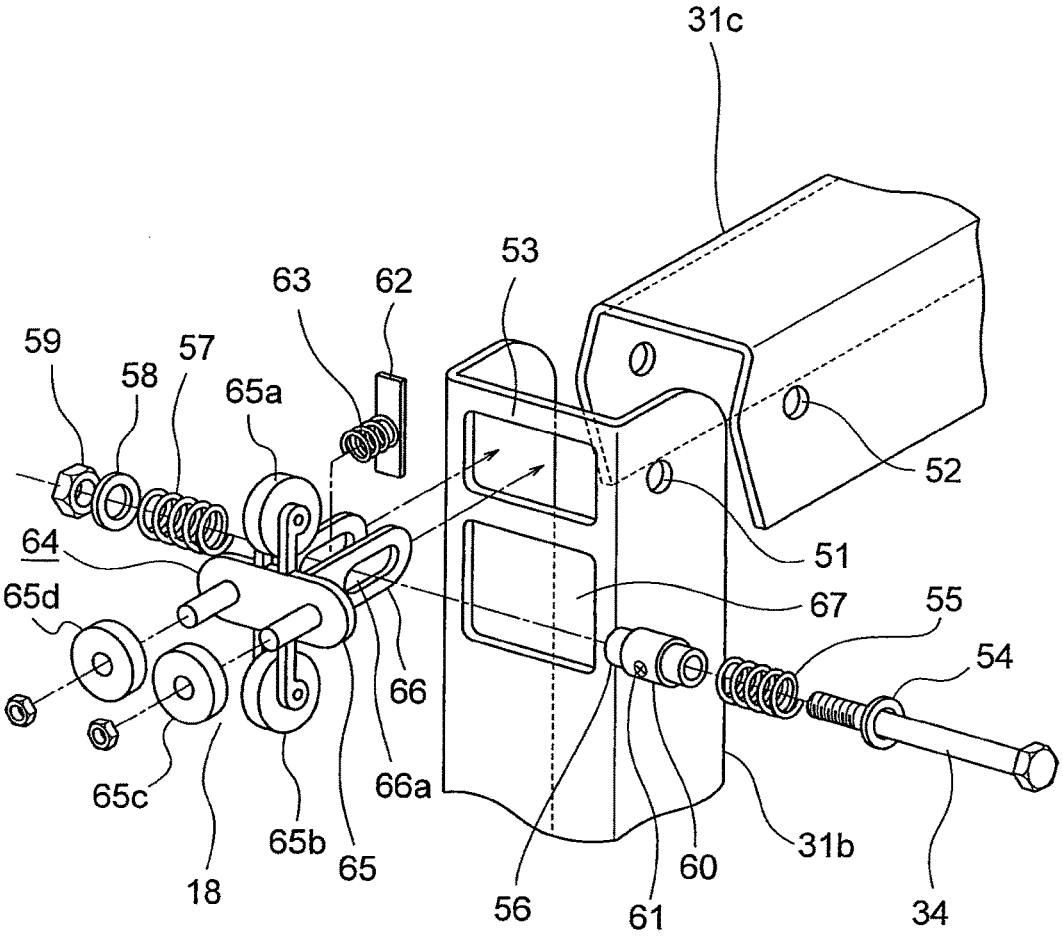
FIG. 19 is an exploded perspective view illustrating a coupling portion between a second stile and a crosshead illustrated in FIG. 18 in an enlarged manner.
Figure 20:
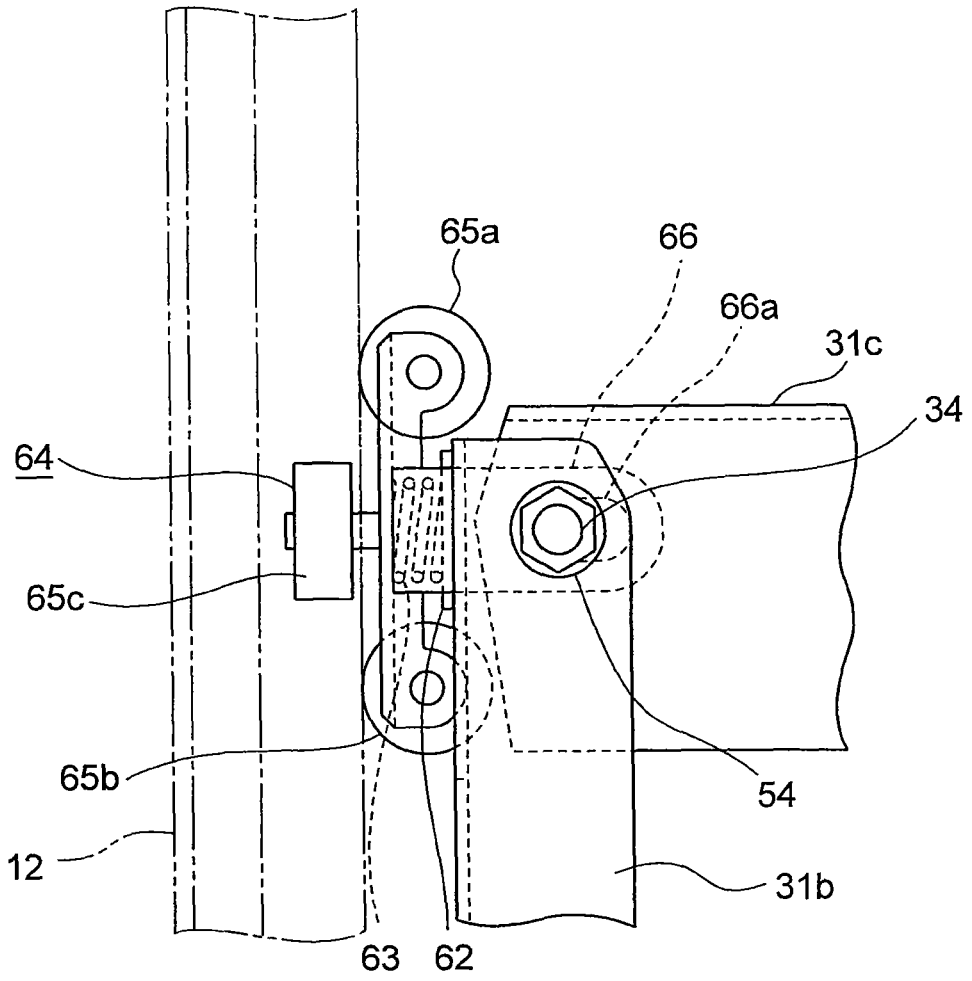
FIG. 20 is a front view illustrating the coupling portion illustrated in FIG. 19.

Next, FIG. 18 is a front view illustrating a counterweight device according to a second embodiment of the present invention, FIG. 19 is an exploded perspective view illustrating a coupling portion between the second stile 31*b* and the crosshead 31*c* illustrated in FIG. 18 in an enlarged manner, and FIG. 20 is a front view illustrating the coupling portion illustrated in FIG. 19.

In the second embodiment, in place of the guide shoes 33 of the first embodiment, roller guide devices 64 are used as the guide devices. Each of the roller guide devices 64 includes a roller guide main body 65 to be brought into engagement with the counterweight guide rail 12 and a roller-guide supporting portion (neck portion) 66 having a U-like shape, which is provided on a back surface of the roller guide main body 65.

Each of the roller guide main bodies 65 includes a pair of face guide rollers 65*a* and 65*b* to roll along a head surface of the counterweight guide rail 12 (surface opposed to the stile 31*a* or 31*b*) and a pair of side guide rollers 65*c* and 65*d* to roll along both side surfaces of the counterweight guide rail 12.

The face guide rollers 65*a* and 65*b* are arranged vertically at a distance from each other. The side guide rollers 65*c* and 65*d* are arranged at the same vertical position to interpose the counterweight guide rail 12 therebetween.

Similarly to the shoe supporting portion 33*b* of the first embodiment, the roller guide supporting portion 66 is inserted into the corresponding opening 53 of the first stile 31*a* or the second stile 31*b*. A plurality of roller relief holes 67 for relieving the face guide rollers 65*a* and 65*b* are formed in the stiles 31*a* and 31*b*. Further, a pair of elongated holes 66*a* through which the pin 34 passes is formed in each of the roller guide supporting portions 66. Further, the oil feeders 38 used in the first embodiment are omitted in the second embodiment. The rest of the configuration is similar or identical to that of the first embodiment.

Figure 21:
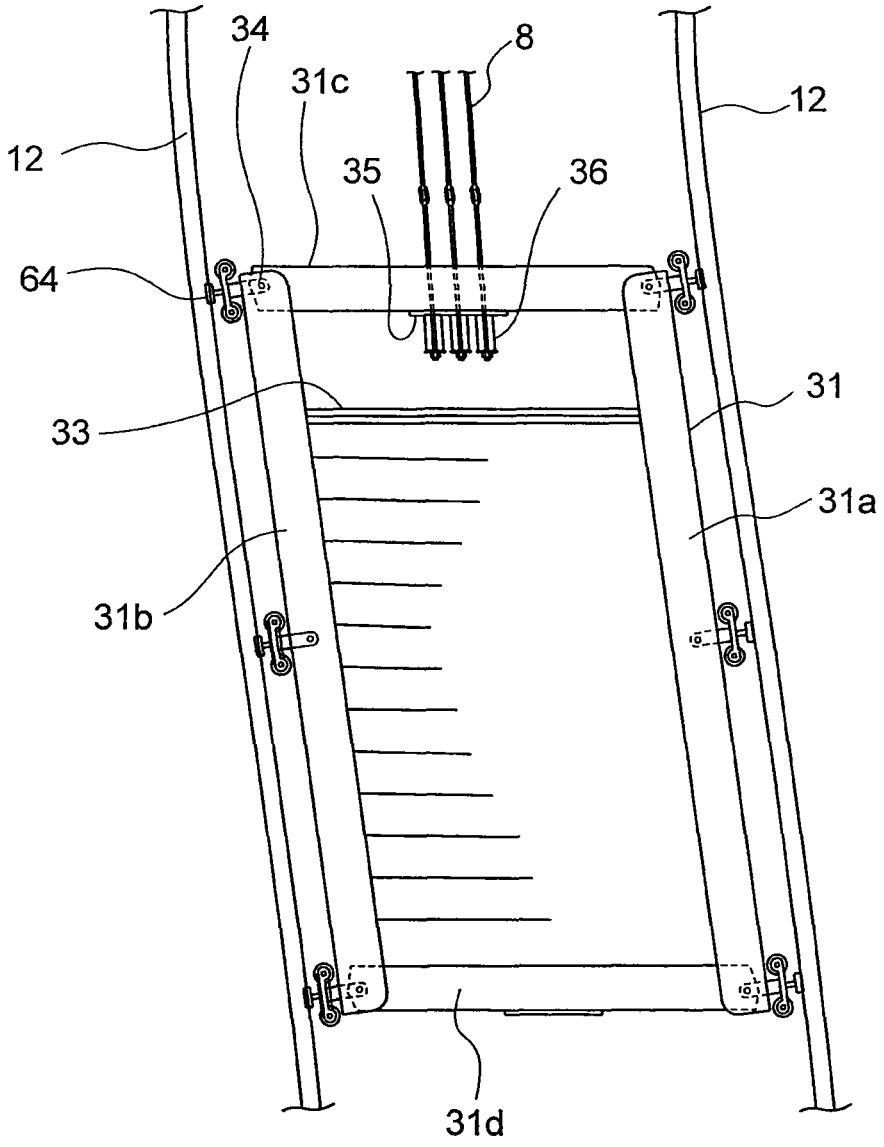
FIG. 21 is a front view illustrating a state of the counterweight device illustrated in FIG. 18 when the counterweight guide rails are deformed as illustrated in FIG. 9.
Figure 22:
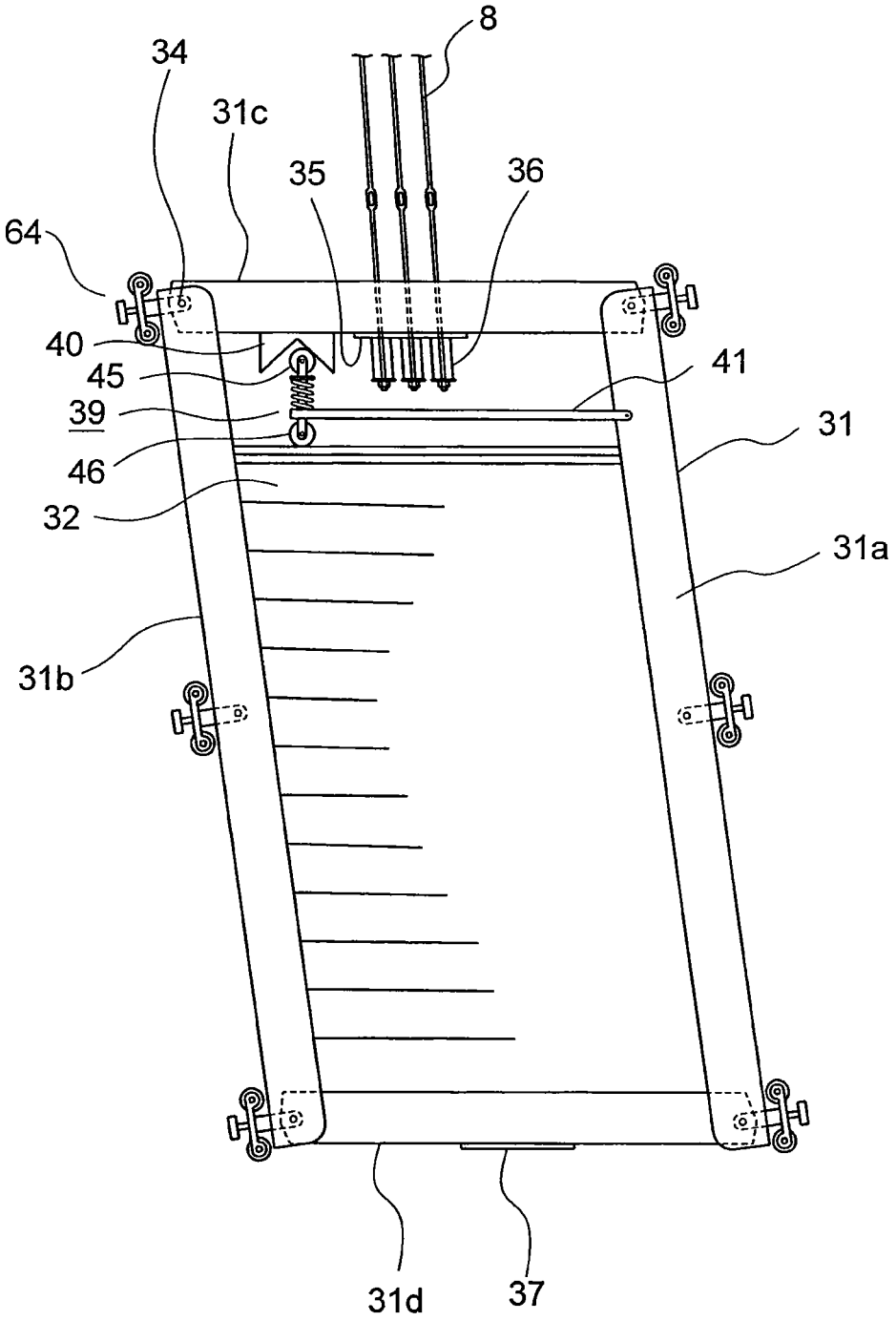
FIG. 22 is a front view illustrating the counterweight device illustrated in FIG. 21 in an enlarged manner.
Figure 23:
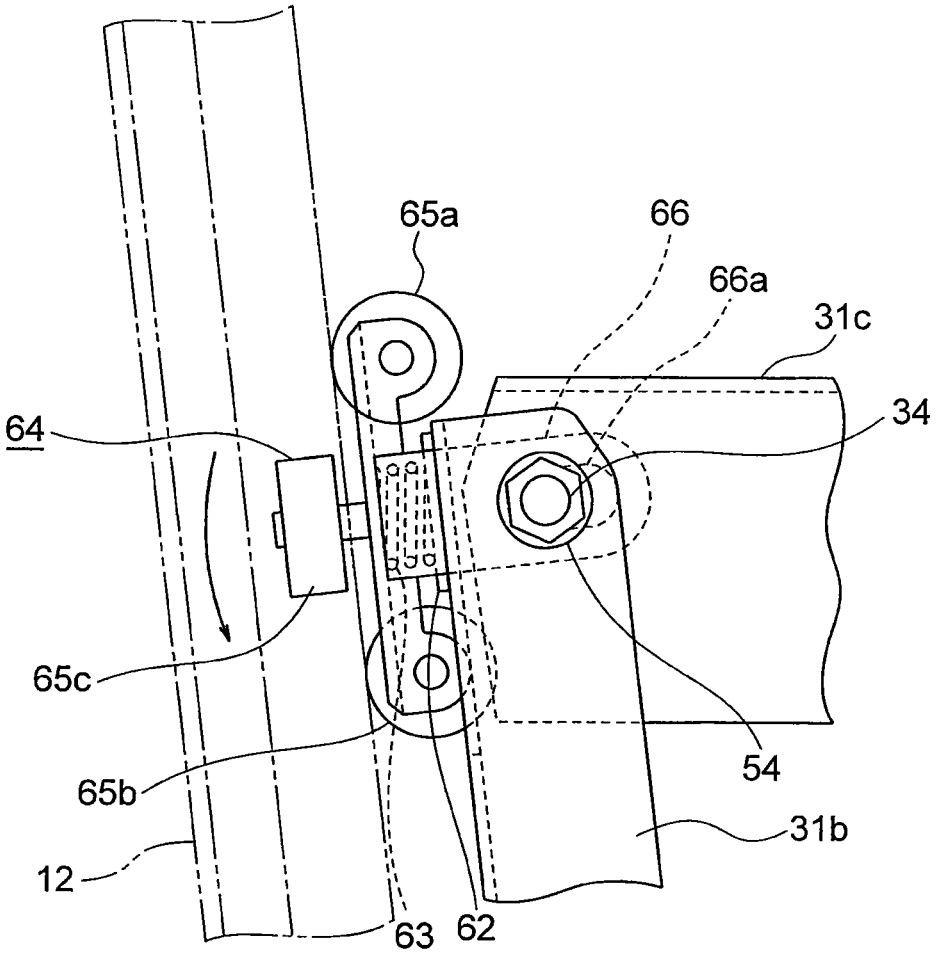
FIG. 23 is a front view illustrating the coupling portion between the second stile and the crosshead illustrated in FIG. 21.

FIG. 21 is a front view illustrating a state of the counterweight device illustrated in FIG. 18 when the counterweight guide rails 12 are deformed as illustrated in FIG. 9, FIG. 22 is a front view illustrating the counterweight device illustrated in FIG. 21 in an enlarged manner, and FIG. 23 is a front view illustrating the coupling portion between the second stile 31*b* and the crosshead 31*c* illustrated in FIG. 21. In FIG. 21, the illustration of the shape retaining device 39 is omitted.

Even the counterweight device described above can flexibly follow the deformation of the counterweight guide rails 12 due to the seismic shaking or the like with the deformation of the frame body 31 and the displacement and pivoting of the roller guide devices 64. Thus, the roller guide devices 64 can be more reliably prevented from derailing from the counterweight guide rails 12.

Third Embodiment

Figure 24:
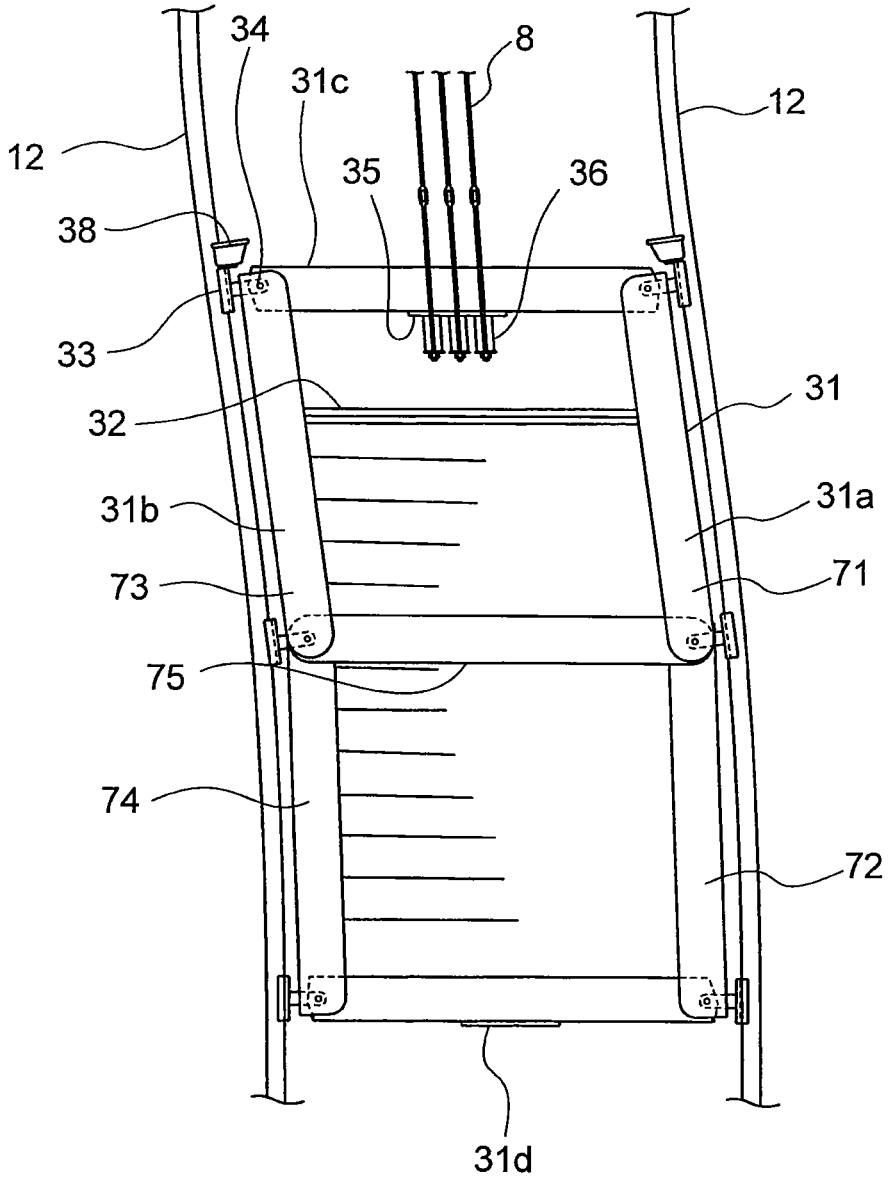
FIG. 24 is a front view illustrating a counterweight device according to a third embodiment of the present invention.
Figure 25:
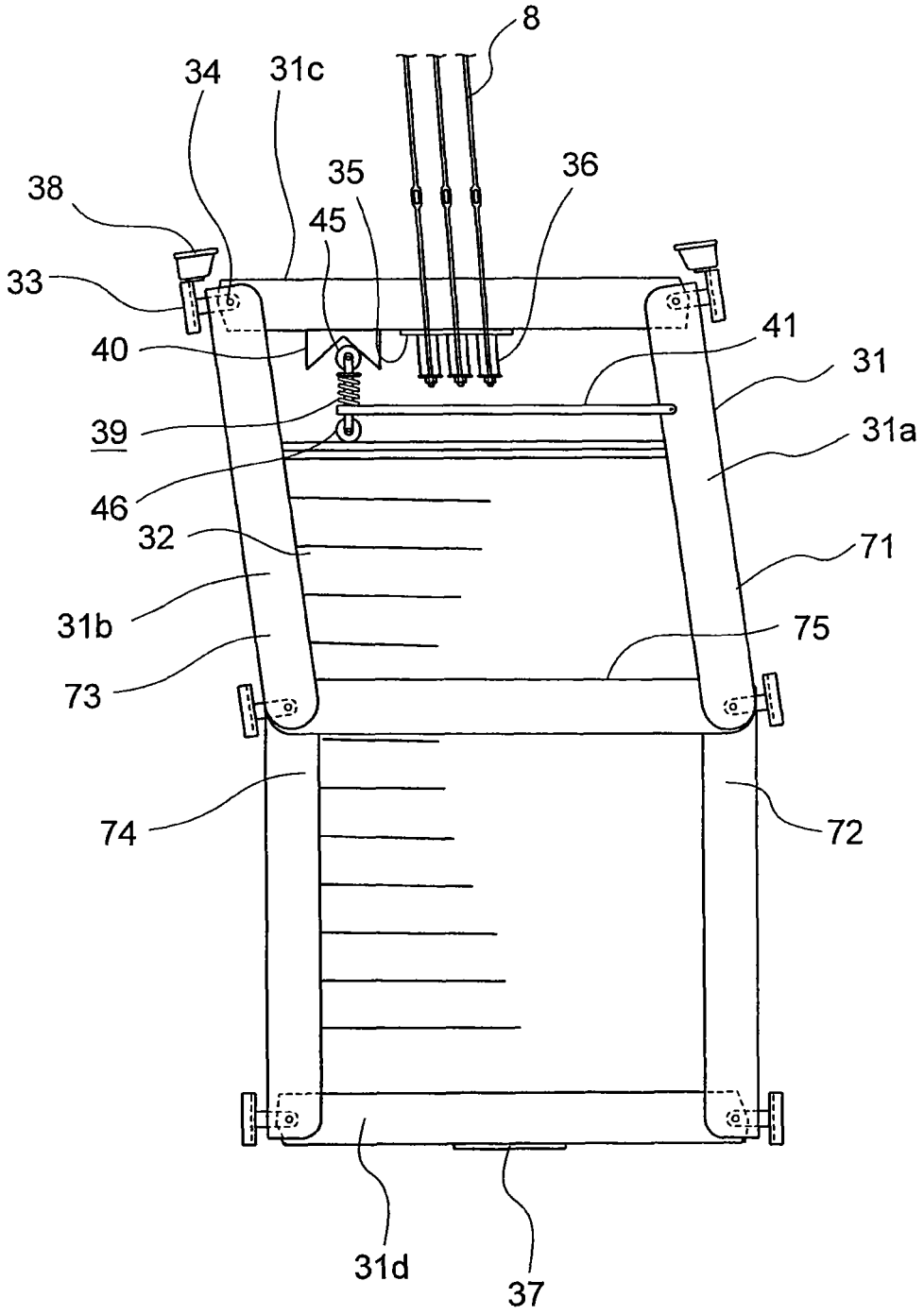
FIG. 25 is a front view illustrating the counterweight device illustrated in FIG. 24 in an enlarged manner.

Next, FIG. 24 is a front view illustrating a counterweight device according to a third embodiment of the present invention, and FIG. 25 is a front view illustrating the counterweight device illustrated in FIG. 24 in an enlarged manner. In FIG. 24, the illustration of the shape retaining device 39 is omitted. Further, FIGS. 24 and 25 illustrate a state when the counterweight guide rails 12 are deformed as illustrated in FIG. 9.

In FIGS. 24 and 25, the first stile 31*a* is divided at a longitudinal (vertical) intermediate portion into a first upper stile 71 and a first lower stile 72. The first upper stile 71 and the first lower stile 72 are coupled (connected by the pin) so as to be pivotable.

The second stile 31*b* is divided at a longitudinal (vertical) intermediate portion into a second upper stile 73 and a second lower stile 74. The second upper stile 73 and the second lower stile 74 are coupled (connected by the pin) so as to be pivotable.

Moreover, the frame body 31 further includes an intermediate frame 75 provided between an intermediate portion of the first stile 31*a* and an intermediate portion of the second stile 31*b*. The intermediate frame 75 is coupled to a coupling portion between the first upper stile 71 and the first lower stile 72 so as to be pivotable and is also coupled to a coupling portion between the second upper stile 73 and the second lower stile 74 so as to be pivotable.

A structure for coupling the intermediate frame 75 to the stiles 31*a* and 31*b* is the same as the structure for coupling the crosshead 31*c* to the stiles 31*a* and 31*b*. The rest of the configuration is similar or identical to that of the first embodiment.

Even the counterweight device described above can flexibly follow the deformation of the counterweight guide rails 12 due to the seismic shaking or the like with the deformation of the frame body 31 and the displacement and pivoting of the guide shoes 33. Thus, the guide shoes 33 can be more reliably prevented from derailing from the counterweight guide rails 12.

As a result of an increased number of joints included in the frame body 31, followability to the deformation of the counterweight guide rails 12 can be further improved. Thus, the counterweight device 10 can more smoothly run.

Fourth Embodiment

Figure 26:
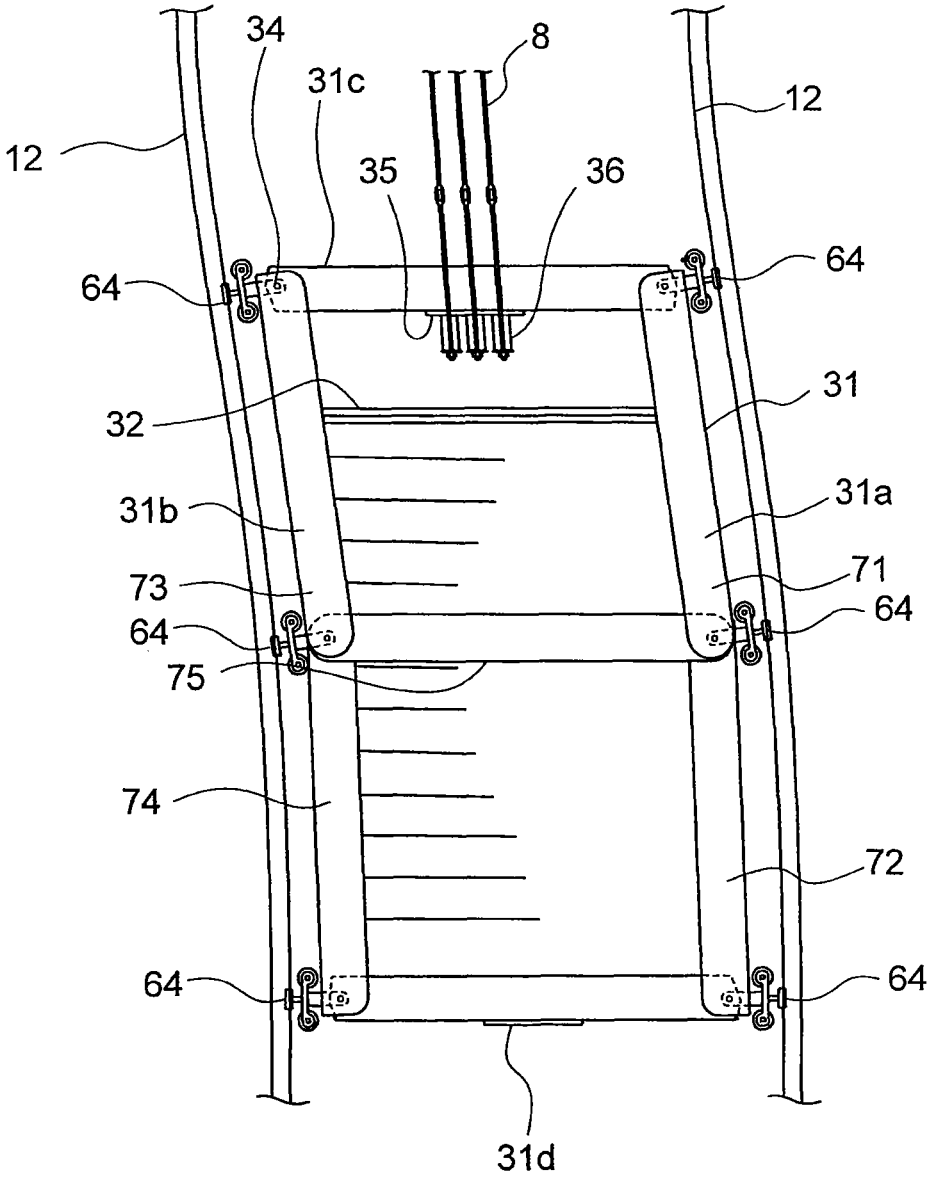
FIG. 26 is a front view illustrating a counterweight device according to a fourth embodiment of the present invention.
Figure 27:
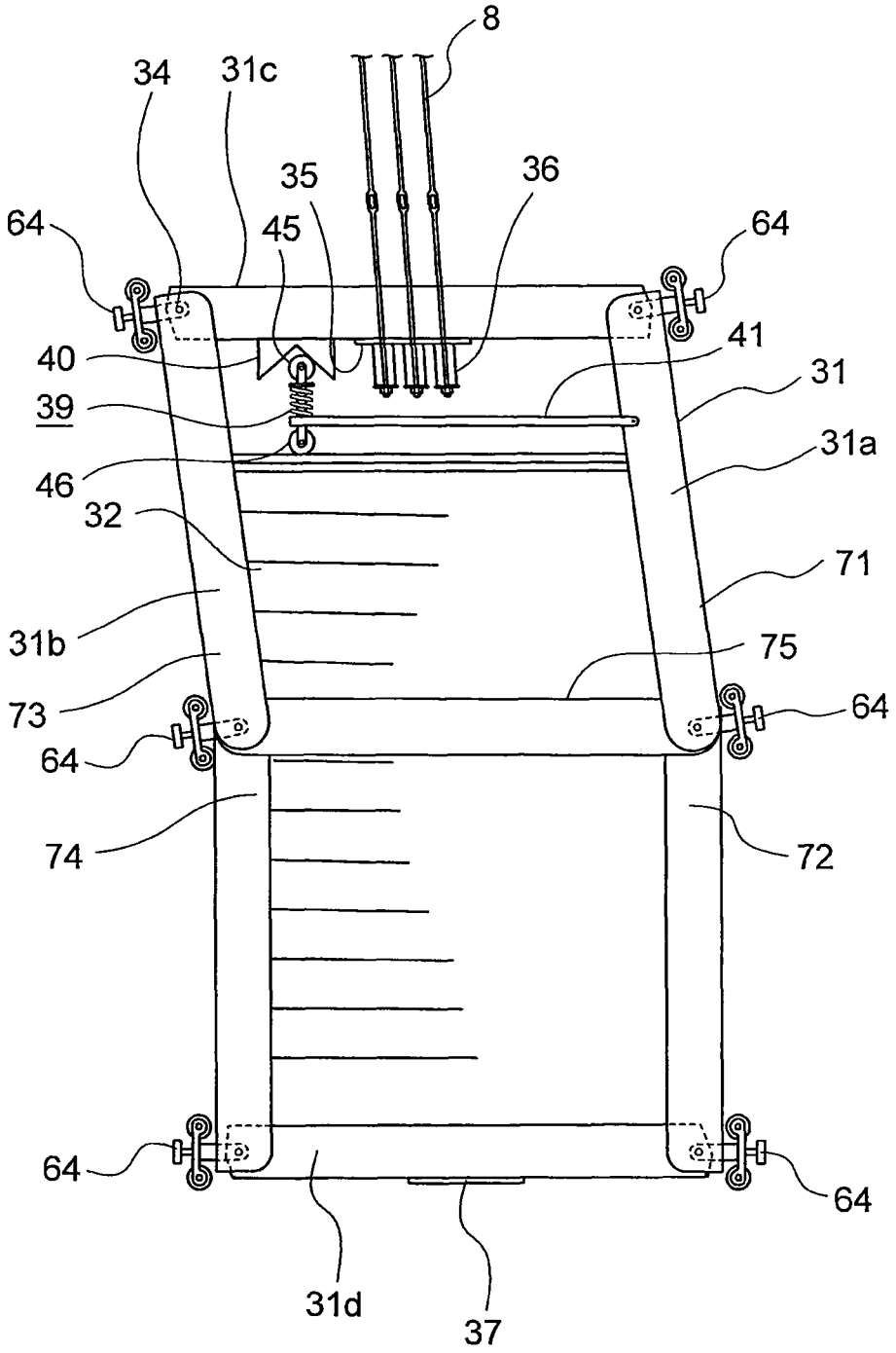
FIG. 27 is a front view illustrating the counterweight device illustrated in FIG. 26 in an enlarged manner.

Next, FIG. 26 is a front view illustrating a counterweight device according to a fourth embodiment of the present invention, and FIG. 27 is a front view illustrating the counterweight device illustrated in FIG. 26 in an enlarged manner. In FIG. 26, the illustration of the shape retaining device 39 is omitted. Further, FIGS. 26 and 27 illustrate a state when the counterweight guide rails 12 are deformed as illustrated in FIG. 9.

In the fourth embodiment, in place of the guide shoes 33 of the third embodiment, the roller guide devices 64 are used as the guide devices. The remaining configuration is the same as that of the first embodiment. Further, the configuration of the roller guide device 64 is similar or identical to that of the second embodiment.

Even the counterweight device described above can flexibly follow the deformation of the counterweight guide rails 12 due to the seismic shaking or the like with the deformation of the frame body 31 and the displacement and pivoting of the roller guide devices 64. Thus, the roller guide devices 64 can be more reliably prevented from derailing from the counterweight guide rails 12.

Further, the number of joints included in the frame body 31 increases as compared with that of the configuration of the second embodiment. As a result, the followability to the deformation of the counterweight guide rails 12 can be further improved. As a result, the counterweight device 10 can more smoothly run.

Fifth Embodiment

Figure 28:
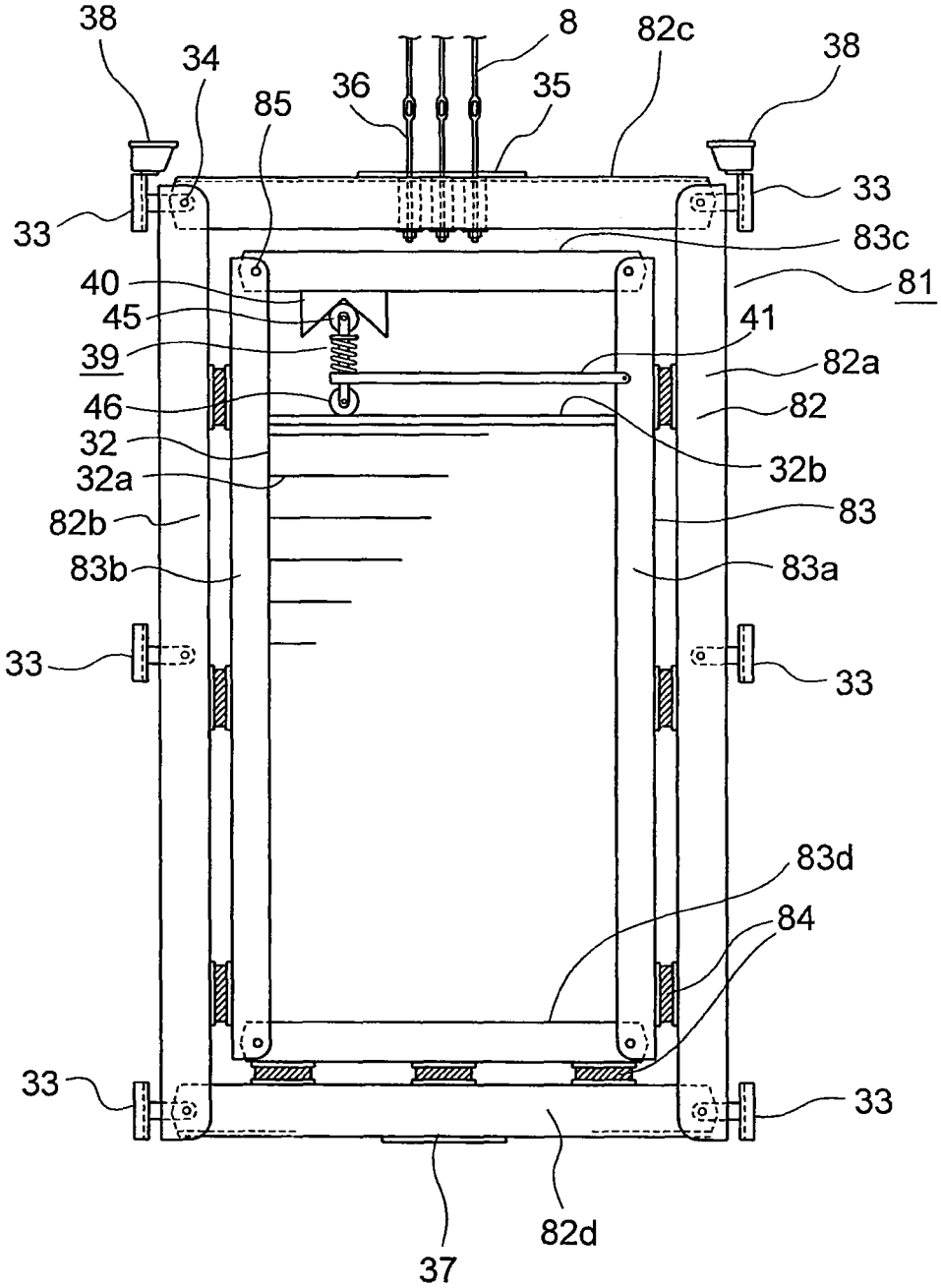
FIG. 28 is a front view illustrating a counterweight device according to a fifth embodiment of the present invention.

Next, FIG. 28 is a front view illustrating a counterweight device according to a fifth embodiment of the present invention. The counterweight device according to the fifth embodiment includes a frame body 81 having a double-frame structure, the counterweight main body 32 mounted at an inside of the frame body 81, and the six guide shoes 33 provided on both sides of the frame body 81 in the width direction.

The frame body 81 includes an outer frame 82, an inner frame 83 provided at an inside of the outer frame 82, and a plurality of vibration isolation members 84 provided between the outer frame 82 and the inner frame 83. Similarly to the frame body 31 of the first embodiment, the outer frame 82 includes a first outer stile 82*a*, a second outer stile 82*b*, an outer crosshead 82*c*, and an outer plank 82*d*.

A structure for coupling the outer crosshead 82*c* and the outer plank 82*d* to the outer stiles 82*a* and 82*b* and a structure for mounting the guide shoes 33 are similar or identical to those of the first embodiment. However, in order to avoid the interference between the fasteners 36 and the inner frame 83, the rope stopper plate 35 is fixed onto an upper surface of the outer crosshead 82*c*. If a distance between the outer crosshead 82*c* and the inner frame 83 is sufficiently ensured, the rope stopper plate 35 may also be fixed onto a lower surface of the outer crosshead 82*c*.

The inner frame 83 includes a first inner stile 83*a*, a second inner stile 83*b*, an inner crosshead 83*c* provided horizontally between an upper portion of the first inner stile 83*a* and an upper portion of the second inner stile 83*b*, and an inner plank 83*d* provided horizontally between a lower portion of the first inner stile 83*a* and a lower portion of the second inner stile 83*b*. The first inner stile 83*a* and the second inner stile 83*b* are parallel to each other, whereas the inner crosshead 83*c* and the inner plank 83*d* are parallel to each other.

Both longitudinal end portions of the inner crosshead 83*c* are coupled to an upper end portion of the first inner stile 83*a* and an upper end portion of the second inner stile 83*b* through pins 85 so as to be pivotable. Both longitudinal end portions of the inner plank 83*d* are coupled to a lower end portion of the first inner stile 83*a* and a lower end portion of the second inner stile 83*b* through the pins 85 so as to be pivotable. As each of the pins 85, a reamer bolt is used.

Each of the outer frame 82 and the inner frame 83 normally has a rectangular shape. However, when the counterweight guide rails 12 are deformed due to the seismic shaking or the like, the outer frame 82 and the inner frame 83 can be deformed into a parallelogram in accordance with the deformation of the counterweight guide rails 12.

The counterweight main body 32 is mounted at an inside of the inner frame 83. Further, the same shape retaining device 39 as that of the first embodiment is provided to the inner frame 83. The three vibration isolation members 84 are arranged vertically at a distance from each other between the first outer stile 82*a* and the first inner stile 83*a*. The three vibration isolation members 84 are also arranged vertically at a distance from each other between the second outer stile 82*b* and the second inner stile 83*b*.

The three vibration isolation members 84 are arranged in the width direction of the frame body 81 at a distance from each other between the outer plank 82*d* and the inner plank 83*d*. The rest of the configuration is similar or identical to that of the first embodiment.

Even the counterweight device described above can flexibly follow the deformation of the counterweight guide rails 12 due to the seismic shaking or the like with the deformation of the frame body 31 and the displacement and pivoting of the guide shoes 33. Thus, the guide shoes 33 can be more reliably prevented from derailing from the counterweight guide rails 12.

Further, the frame body 81 is formed to have the double-frame structure, and the vibration isolation members 84 are provided between the outer frame 82 and the inner frame 83. Thus, a lateral-vibration acceleration of the counterweight device can be reduced to further improve earthquake resistance.

Sixth Embodiment

Figure 29:
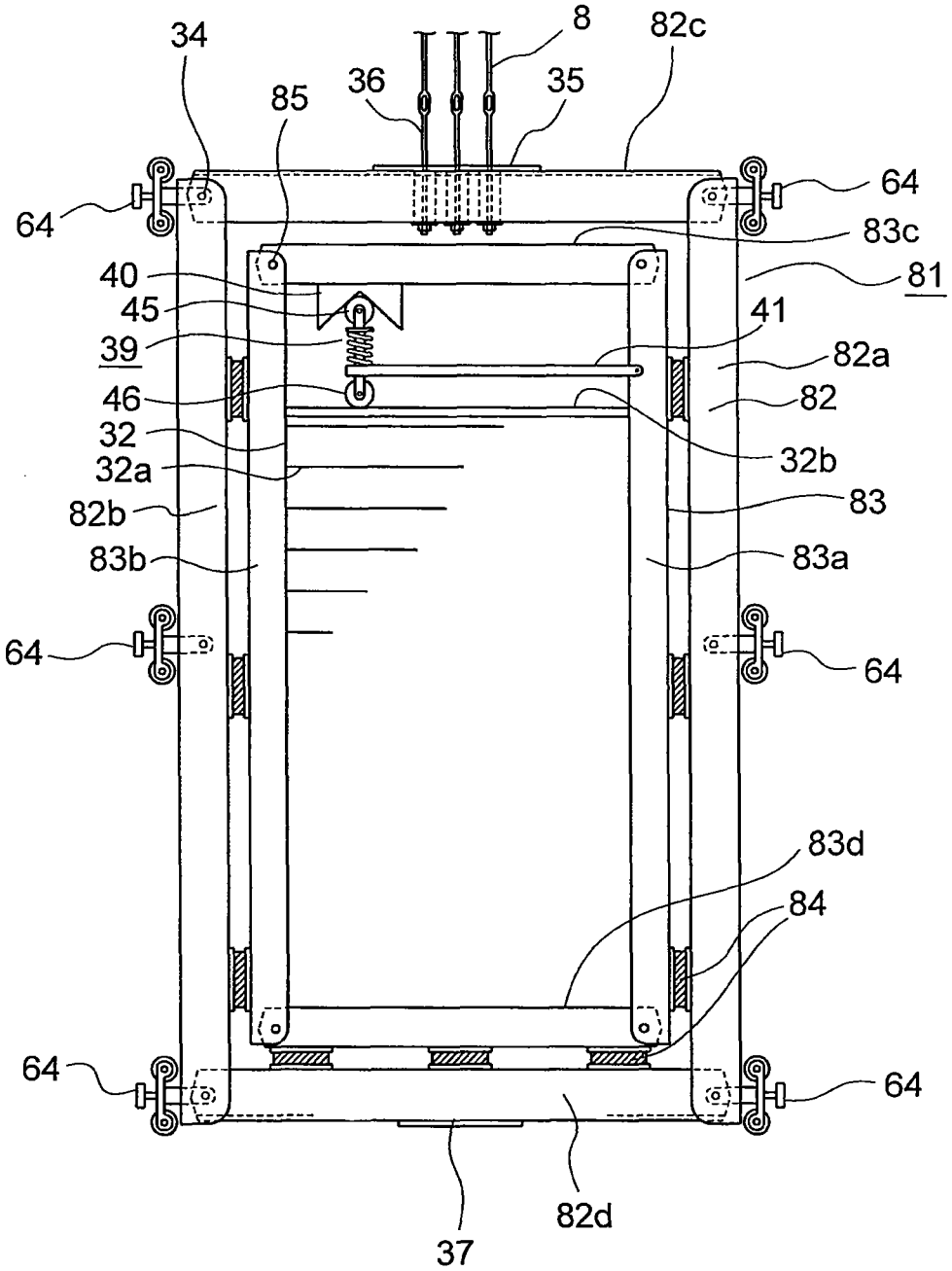
FIG. 29 is a front view illustrating a counterweight device according to a sixth embodiment of the present invention.

Next, FIG. 29 is a front view illustrating a counterweight device according to a sixth embodiment of the present invention. In the sixth embodiment, in place of the guide shoes 33 of the fifth embodiment, the roller guide devices 64 are used as the guide devices. The remaining configuration is the same as that of the fifth embodiment. Further, the configuration of the roller guide device 64 is similar or identical to that of the second embodiment.

Even the counterweight device described above can flexibly follow the deformation of the counterweight guide rails 12 due to the seismic shaking or the like with the deformation of the frame body 31 and the displacement and pivoting of the roller guide devices 64. Thus, the roller guide devices 64 can be more reliably prevented from derailing from the counterweight guide rails 12.

Further, the lateral-vibration acceleration of the counterweight device can be reduced by the vibration isolation members 84 to further improve the earthquake resistance.

Seventh Embodiment

Figure 30:
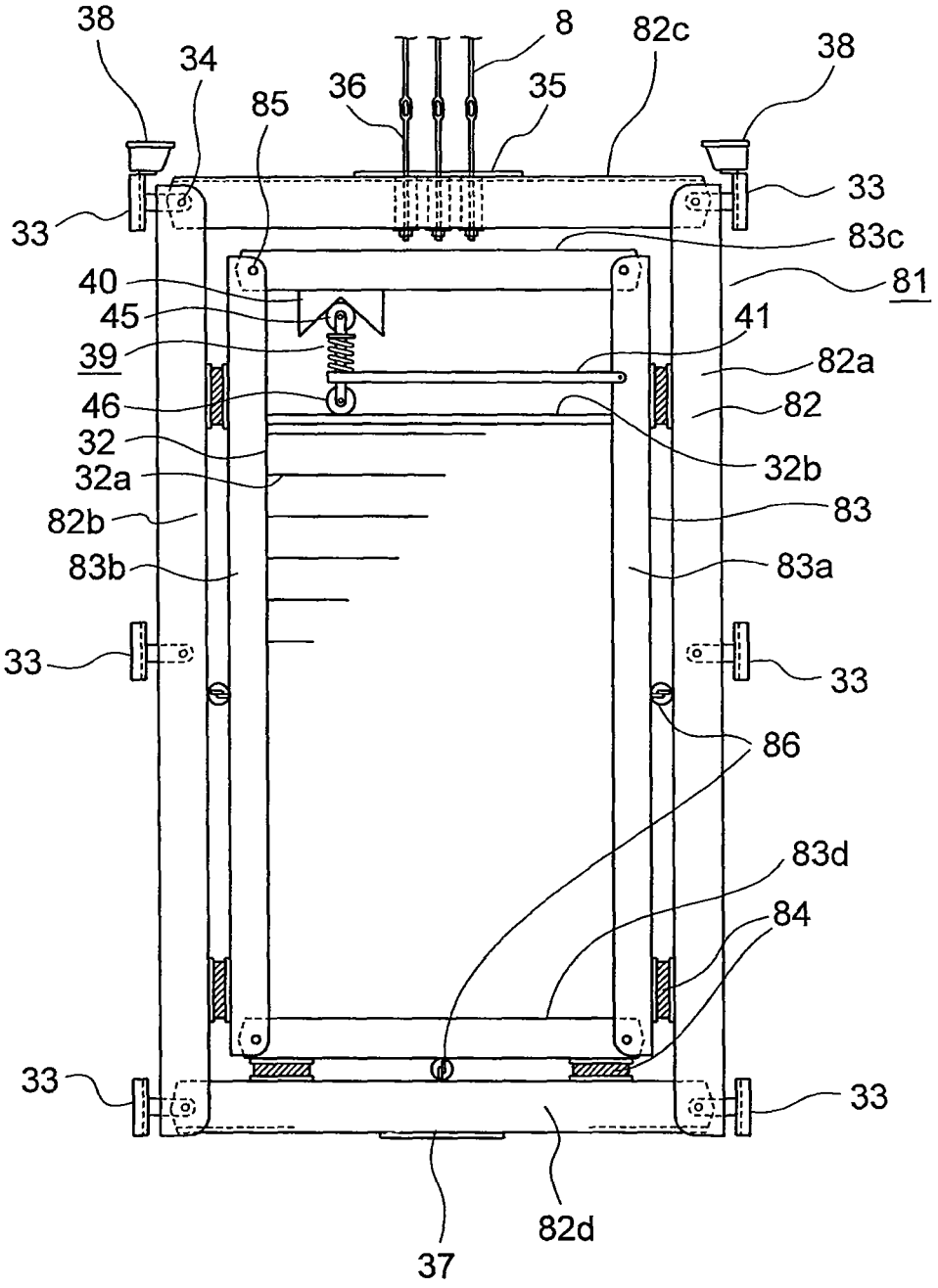
FIG. 30 is a front view illustrating a counterweight device according to a seventh embodiment of the present invention.

Next, FIG. 30 is a front view illustrating a counterweight device according to a seventh embodiment of the present invention. In the seventh embodiment, in place of some of the vibration isolation members 84 of the fifth embodiment, a plurality of buffers 86 are provided between the outer frame 82 and the inner frame 83. Each of the buffers 86 lowers an acceleration of the inner frame 83 in the thickness direction to the outer frame 82. Further, as the buffers 86, for example, hydraulic dampers are used. The rest of the configuration is similar or identical to that of the sixth embodiment.

According to the configuration described above, the acceleration of the inner frame 83 in the thickness direction to the outer frame 82 can be lowered by the resistance of the buffers 86. Thus, in addition to the effects provided by the fifth embodiment, the earthquake resistance can be further improved.

Eighth Embodiment

Figure 31:
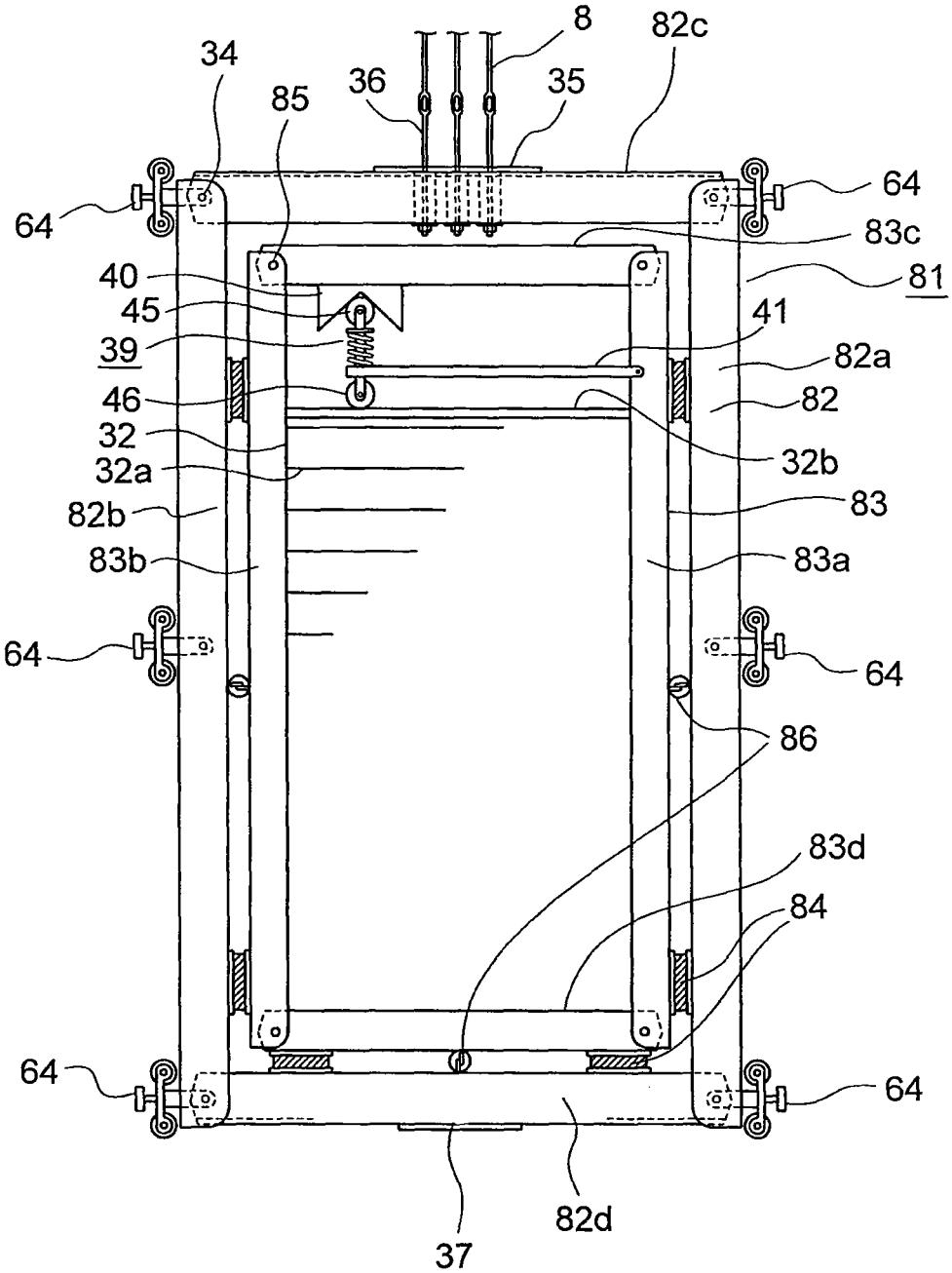
FIG. 31 is a front view illustrating a counterweight device according to an eighth embodiment of the present invention.

Next, FIG. 31 is a front view illustrating a counterweight device according to an eighth embodiment of the present invention. In the eighth embodiment, in place of the guide shoes 33 of the seventh embodiment, the roller guide devices 64 are used as the guide devices. The remaining configuration is similar or identical to that of the seventh embodiment.

Further, the configuration of the roller guide device 64 is the same as that of the second embodiment.

According to the configuration described above, the acceleration of the inner frame 83 in the thickness direction to the outer frame 82 can be lowered by the resistance of the buffers 86. Thus, in addition to the effects provided by the sixth embodiment, the earthquake resistance can be further improved.

The type of elevator apparatus to which the present invention is applicable is not limited to that illustrated in FIG. 1. The present invention is also applicable to, for example, a machine room-less elevator, a multi-car elevator apparatus, a double-deck elevator, or the like.

Further, the positions and the number of elevator devices such as the hoisting machine 3, the controller 5, the suspension body 8, the counterweight device 10, and the guide rails 11 and 12 are not limited to those of the examples described above. For example, the present invention is also applicable to a 2:1 roping elevator apparatus.

The invention claimed is:

1. An elevator counterweight device, comprising:

a frame body including:

a first stile;

a second stile;

a crosshead provided between an upper portion of the first stile and an upper portion of the second stile; and a plank provided between a lower portion of the first stile and a lower portion of the second stile;

a counterweight main body mounted at an inside of the frame body; and a plurality of guide devices provided on both sides of the frame body in a width direction thereof, and to be brought into engagement with a pair of guide rails installed at an inside of a hoistway, wherein:

the crosshead and the plank are coupled to the first stile and the second stile so as to be pivotable; and each of the plurality of guide devices is displaceable in the width direction of the frame body and a thickness direction of the frame body relative to the frame body, and is pivotable about an axis parallel to a vertical direction of the frame body as a center.

2. The elevator counterweight device according to claim 1, wherein:

the frame body normally has a rectangular shape; and the frame body further includes a shape retaining device for generating a force for restoring the frame body to the rectangular shape when the frame body is deformed due to deformation of the pair of guide rails.

3. The elevator counterweight device according to claim 2, wherein the shape retaining device includes:

a cam, body provided to the crosshead and provided with a cam groove having a triangular cross section;

a pressing roller provided at an inside of the cam groove;

an arm coupled between at least one of the first stile or the second stile and the pressing roller; and a pressing spring for pressing the pressing roller against the cam groove.

4. The elevator counterweight device according to claim 1, wherein:

the first stile is divided into a first upper stile and a first lower stile;

the second stile is divided into a second upper stile and a second lower stile;

the first upper stile and the first lower stile are coupled to each other so as to be pivotable;

the second upper stile and the second lower stile are coupled to each other so as to be pivotable;

the frame body further includes an intermediate frame provided between an intermediate portion of the first stile and an intermediate portion of the second stile; and the intermediate frame is coupled to a coupling portion between the first upper stile and the first lower stile so as to be pivotable and is coupled to a coupling portion between the second upper stile and the second lower stile so as to be pivotable.

5. The elevator counterweight device according to claim 1, wherein:

the frame body includes:

an outer frame;

an inner frame provided at an inside of the outer frame; and a plurality of vibration isolation members provided between the outer frame and the inner frame;

the outer frame comprises:

a first outer stile as the first stile;

a second inner stile as the second stile;

an outer crosshead as the crosshead; and an outer plank as the plank;

the inner frame comprises:

a first inner stile;

a second inner stile;

an inner crosshead provided between an upper portion of the first inner stile and an upper portion of the second inner stile; and an inner plank provided between a lower portion of the first inner stile and a lower portion of the second inner stile; and the inner crosshead and the inner plank are respectively coupled to the first inner stile and the second inner stile so as to be pivotable.

6. The elevator counterweight device according to claim 5, wherein a buffer for lowering an acceleration of the inner frame in the thickness direction to the outer frame is provided between the outer frame and the inner frame.

7. The elevator counterweight device according to claim 1, wherein the plurality of guide devices comprise roller guide devices, each including a plurality of guide rollers to roll along the pair of guide rails.

* * * * *